US009080227B2

(12) United States Patent
Oishi et al.

(10) Patent No.: US 9,080,227 B2
(45) Date of Patent: Jul. 14, 2015

(54) COPPER ALLOY SHEET AND METHOD OF MANUFACTURING COPPER ALLOY SHEET

(71) Applicants: Mitsubishi Shindoh Co., Ltd., Tokyo (JP); MITSUBISHI MATERIALS CORPORATION, Tokyo (JP)

(72) Inventors: Keiichiro Oishi, Osaka (JP); Takashi Hokazono, Osaka (JP); Michio Takasaki, Osaka (JP); Yosuke Nakasato, Osaka (JP)

(73) Assignees: Mitsubishi Shindoh Co., Ltd., Tokyo (JP); MITSUBISHI MATERIALS CORPORATION, Tokyo (JP)

( * ) Notice: Subject to any disclaimer, the term of this patent is extended or adjusted under 35 U.S.C. 154(b) by 0 days.

(21) Appl. No.: 14/238,125

(22) PCT Filed: Sep. 19, 2012

(86) PCT No.: PCT/JP2012/073896
§ 371 (c)(1),
(2) Date: Feb. 10, 2014

(87) PCT Pub. No.: WO2013/042678
PCT Pub. Date: Mar. 28, 2013

(65) Prior Publication Data

US 2014/0193292 A1 Jul. 10, 2014

(30) Foreign Application Priority Data

Sep. 20, 2011 (JP) ..... 2011-204177

(51) Int. Cl.

| | |
|---|---|
| ***C22C 9/02*** | (2006.01) |
| ***C22C 9/04*** | (2006.01) |
| ***C22F 1/08*** | (2006.01) |
| *C22F 1/00* | (2006.01) |

(52) U.S. Cl.
CPC ... *C22C 9/04* (2013.01); *C22F 1/08* (2013.01); *C22F 1/00* (2013.01)

(58) Field of Classification Search
CPC ..... C22C 9/00; C22C 9/02; C22C 9/04; C22C 9/06
USPC ..... 420/472
See application file for complete search history.

(56) References Cited

U.S. PATENT DOCUMENTS

2011/0265917 A1 11/2011 Oishi

FOREIGN PATENT DOCUMENTS

| | | | | | |
|---|---|---|---|---|---|
| CA | 2 842 488 | A1 | | 2/2013 | |
| CN | 1683579 | A | | 10/2005 | |
| JP | 2004-285449 | A | | 10/2004 | |
| JP | 2004285449 | A | * | 10/2004 | ..... C22C 9/04 |
| JP | 2007-056365 | A | | 3/2007 | |
| JP | 2007-211317 | A | | 8/2007 | |
| JP | 2009-062610 | A | | 3/2009 | |
| TW | 200722534 | | | 6/2007 | |
| TW | 200722536 | | | 6/2007 | |
| WO | 2004/022805 | A1 | | 3/2004 | |
| WO | 2010/079707 | A1 | | 7/2010 | |

OTHER PUBLICATIONS eFunda. Copper Alloy UNS C26000. http://www.efunda.com/materials/alloys/copper/show_copper.cfm?ID=UNS_C26000&show_prop=all&Page_Title=UNS%20C26000.*
Office Action issued in co-pending related U.S. Appl. No. 14/176,914 on Jun. 20, 2014.
Office Action issued in corresponding Canadian application 2,844,247 on May 27, 2014.
E. O. Hall., Proc. Phys. Soc. London, 64 (1951), pp. 747-753.
N. J. Petch et al., Journal of the Iron and Steel Institute, 174 (1953), p. 25-28.
International Search Report issued in corresponding application PCT/JP2012/073896, completed Dec. 7, 2012 and mailed Dec. 18, 2012.
Notice of Allowance issued in co-pending Taiwanese application 101134311 on Feb. 21, 2014.

* cited by examiner

*Primary Examiner* — Kaj K Olsen
*Assistant Examiner* — Alexander Polyansky
(74) *Attorney, Agent, or Firm* — Griffin & Szipl, P.C.

(57) ABSTRACT

A copper alloy sheet according to one aspect contains 28.0 mass % to 35.0 mass % of Zn, 0.15 mass % to 0.75 mass % of Sn, 0.005 mass % to 0.05 mass % of P, and a balance consisting of Cu and unavoidable impurities, in which relationships of $44 \geq [Zn]+20\times[Sn] \geq 37$ and $32 \leq [Zn]+9\times([Sn]-0.25)^{1/2} \leq 37$ are satisfied. The copper alloy sheet according to the aspect is manufactured by a manufacturing process including a finish cold-rolling process of cold-rolling a copper alloy material, an average grain size of the copper alloy material is 2.0 μm to 7.0 μm, and a sum of an area ratio of a β phase and an area ratio of a γ phase in a metallographic structure of the copper alloy material is 0% to 0.9%.

12 Claims, No Drawings

COPPER ALLOY SHEET AND METHOD OF MANUFACTURING COPPER ALLOY SHEET

This is a National Phase Application in the United States of International Patent Application No. PCT/JP2012/073896 filed Sep. 19, 2012, which claims priority on Japanese Patent Application No. 2011-204177, filed Sep. 20, 2011. The entire disclosures of the above patent applications are hereby incorporated by reference.

TECHNICAL FIELD

The present invention relates to a copper alloy sheet and a method of manufacturing a copper alloy sheet. In particular, the invention relates to a copper alloy sheet, which is superior in balance between specific strength, elongation, and conductivity and in bending workability, and a method of manufacturing a copper alloy sheet.

BACKGROUND ART

In the related art, a high-conductivity and high-strength copper alloy sheet is used as components, such as a connector, a terminal, a relay, a spring, and a switch, which are used in electrical components, electronic components, automobile components, communication apparatuses, and electronic and electrical apparatuses. However, along with a reduction in the size and weight of such apparatuses of recent years and an improvement in performance, components which are used for the apparatuses have also been required to have extremely strict characteristic improvement and cost performance. For example, an ultra-thin sheet is used in a spring contact portion of a connector. In a high-strength copper alloy constituting such an ultra-thin sheet, in order to reduce the thickness thereof, a high strength and a high balance between elongation and strength are required. Further, high productivity, particularly, superior economic efficiency is required by suppressing use of copper, which is a noble metal, to a minimum.

As a high-strength copper alloy, phosphor bronze for a spring and nickel silver for a spring are known. As a high-conductive and high-strength copper alloy which is commonly used and superior in cost performance, brass is well-known in the related art. These well-known high-strength copper alloys have the following problems and cannot satisfy the above-described requirements.

Phosphor bronze and nickel silver are poor in hot workability and are difficult to manufacture by hot-rolling, and thus are typically manufactured by horizontal continuous casting. Accordingly, productivity is poor, energy cost is high, and the yield is poor. In addition, phosphor bronze and nickel silver, which are representative high-strength alloys, contains a large amount of copper which is a noble metal or contains a large amount of Sn or Ni which is expensive. Therefore, there is a problem in economic efficiency, and conductivity is poor. In addition, since these alloys have a high density of approximately 8.8, there is a problem of a reduction in the weight of the apparatuses.

Brass is inexpensive but it is not satisfactory in terms of strength. Therefore, brass is inappropriate as the above-described small-sized and high-performance product component.

Accordingly, such high-conductive and high-strength copper alloys cannot satisfy requirements as components of various kinds of apparatuses which require superior cost performance, a reduction in size and weight, and an improvement in performance. Therefore, the development of a new high-strength copper alloy has been strongly demanded.

As an alloy for satisfying the above-described requirements of high conductivity and high strength, for example, a Cu—Zn—Sn alloy disclosed in Patent Document 1 is known. However, the alloy disclosed in Patent Document 1 does not have a sufficient strength as well.

Among common components such as a connector, a terminal, a relay, a spring, and a switch which are used in electrical components, electronic components, automobile components, communication apparatuses, and electronic and electrical apparatuses, there are components and portions which require a higher strength for reducing the thickness on the condition that elongation and bending workability are superior, and there are components and portions which require higher conductivity and stress relaxation characteristics for causing a high current to flow. However, strength and conductivity are properties contradictory to each other. In general, if a strength is improved, conductivity is decreased. Under these circumstances, a high-strength component is known which requires a tensile strength of, for example, 540 $N/mm^2$ or higher and a conductivity of 21% IACS or higher, for example, approximately 25% IACS. Specifically, this component is used as a connector or the like and has a high strength and superior cost performance on the condition that elongation and bending workability are sufficient. Incidentally, regarding cost performance, not only copper belonging to noble metals but also elements having a cost higher than or equal to that of copper are not used in large amounts. Specifically, the total content of copper and elements having a cost higher than or equal to that of copper is suppressed to be at least less than or equal to 71.5 mass % or less than or equal to 71%. In addition, the density of the alloy is decreased to be less than 8.94 $g/cm^3$, which is the density of pure copper, and less than 8.8 $g/cm^3$ to 8.9 $g/cm^3$, which is the density of the above-described phosphor bronze and the like, by approximately 3%. Specifically, the density of the alloy is set to be at least less than or equal to 8.55 $g/cm^3$. As the density is decreased, a specific strength is increased correspondingly, which leads to cost reduction. In addition, the weight of a component can also be decreased.

RELATED ART DOCUMENT

Patent Document

[Patent Document 1] JP-A-2007-56365

DISCLOSURE OF THE INVENTION

Problem that the Invention is to Solve

The invention has been made in order to solve the above-described problems of the related art, and an object thereof is to provide a copper alloy sheet which is superior in balance between specific strength, elongation, and conductivity and in bending workability and stress relaxation characteristics.

Means to Solve the Problems

The present inventors have focused on the Hall-Petch relational expression (refer to E. O. Hall, Proc. Phys. Soc. London. 64 (1951) 747 and N.J. Petch, J. Iron Steel Inst. 174 (1953) 25) in which a proof strength of 0.2% (a strength when a permanent strain is 0.2%; hereinafter, simply referred to as "proof strength") increases in proportion to the −½ power of a grain size $D_0$ ($D_0^{-1}$); and have thought that a high-strength copper alloy capable of satisfying the above-described recent requirements can be obtained by refining crystal grains according to the Hall-Petch relational expression. Therefore, the present inventors have performed various studies and experiments regarding the refinement of crystal grains.

As a result, the following findings were obtained.

The refinement of crystal grains can be realized by recrystallizing a copper alloy depending on added elements. By refining crystal grains (recrystallized grains) to a certain grain size or less, a strength such as a tensile strength or a proof strength can be significantly improved. That is, as an average grain size is decreased, a strength is increased.

Specifically, various experiments regarding effects of added elements on the refinement of crystal grains were performed. As a result, the following facts were found.

The addition of Zn and Sn to Cu has an effect of increasing nucleation sites of recrystallization nuclei. Further, the addition of P to a Cu—Zn—Sn alloy has an effect of suppressing grain growth. Therefore, it was found that, by using these effects, a Cu—Zn—Sn—P alloy having fine crystal grains and an alloy including either or both of Co and Ni, which have the effect of suppressing grain growth, can be obtained.

That is, one of the major reasons for the increase in nucleation sites of recrystallization nuclei is presumed to be that a stacking fault energy is decreased by the addition of Zn and Sn which are divalent and tetravalent, respectively. The addition of P is effective for maintaining generated fine recrystallized grains as they are. Further, a fine precipitate which is formed by the addition of P, Co, and Ni suppresses the growth of fine crystal grains. In this case, even if the ultra-fine refinement of recrystallized grains is aimed, balance between strength, elongation, and bending workability is not obtained. In order to maintain a high balance, it is preferable that the refinement of recrystallized grains be performed with a sufficient margin and that a grain refinement region have a size in a specific range. Regarding the refinement or ultra-fine refinement of crystal grains, the minimum grain size in a standard image described in JIS H 0501 is 0.010 mm. Based on this minimum grain size, the present inventors thought that an average grain size being less than or equal to 0.007 mm can be defined as crystal grains being refined, and an average grain size being less than or equal to 0.004 mm (4 microns) can be defined as crystal grains being ultra-refined.

The invention has been completed based on the above-described findings of the present inventors. That is, in order to solve the above-described problems, the following aspects of the invention are provided.

According to an aspect of the invention, there is provided a copper alloy sheet which is manufactured by a manufacturing process including a finish cold-rolling process of cold-rolling a copper alloy material. In this copper alloy sheet, an average grain size of the copper alloy material is 2.0 μm to 7.0 μm; in the copper alloy material, an α phase is a matrix and a sum of an area ratio of a β phase and an area ratio of a γ phase in a metallographic structure is 0% to 0.9%; the copper alloy sheet contains 28.0 mass % to 35.0 mass % of Zn, 0.15 mass % to 0.75 mass % of Sn, 0.005 mass % to 0.05 mass % of P, and a balance consisting of Cu and unavoidable impurities; and a Zn content [Zn] (mass %) and a Sn content [Sn] (mass %) satisfy relationships of $44 \geq [Zn]+20\times[Sn] \geq 37$ and $32 \leq [Zn]+9\times([Sn]-0.25)^{1/2} \leq 37$ (where, when the Sn content is less than or equal to 0.25%, a value of $([Sn-0.25]^{1/2}$ is 0).

According to this aspect of the invention, a copper alloy material having crystal grains with a predetermined grain size and a precipitate with a predetermined particle size is cold-rolled. However, even after cold-rolling, crystal grains before rolling; and β and γ phases in an α phase matrix can be recognized. Therefore, after rolling, a grain size of the crystal grains before rolling and area ratios of the β phase and the γ phase can be measured. In addition, since the volume of the crystal grains is the same even after rolling, an average grain size of the crystal grains is not changed before and after cold-rolling. In addition, since the volumes of the β phase and the γ phase are the same even after rolling, the area ratios of the β phase and the γ phase are not changed before and after cold-rolling.

In addition, hereinafter, the copper alloy material will be also appropriately referred to as "rolled sheet".

According to the aspect of the invention, since the average grain size of the crystal grains in the copper alloy material before finish cold-rolling; and the area ratios of the β phase and the γ phase are in the predetermined preferable ranges, the copper alloy sheet is superior in balance between specific strength, elongation, and conductivity and in bending workability.

In addition, according to another aspect of the invention, there is provided a copper alloy sheet which is manufactured by a manufacturing process including a finish cold-rolling process of cold-rolling a copper alloy material. In this copper alloy sheet, an average grain size of the copper alloy material is 2.0 μm to 7.0 μm; a sum of an area ratio of a β phase and an area ratio of a γ phase in a metallographic structure of the copper alloy material is 0% to 0.9%; the copper alloy sheet contains 28.0 mass % to 35.0 mass % of Zn, 0.15 mass % to 0.75 mass % of Sn, 0.005 mass % to 0.05 mass % of P, either or both of 0.005 mass % to 0.05 mass % of Co and 0.5 mass % to 1.5 mass % of Ni, and a balance consisting of Cu and unavoidable impurities; and a Zn content [Zn] (mass %) and a Sn content [Sn] (mass %) satisfy relationships of $44 \geq [Zn]+20\times[Sn]n \geq 37$ and $32 \leq [Zn]+9\times([Sn]-0.25)^{1/2} \leq 37$ (where, when the Sn content is less than or equal to 0.25%, a value of $([Sn-0.25]^{1/2}$ is 0).

According to the aspect of the invention, since the average grain size of the crystal grains in the copper alloy material before finish cold-rolling; and the area ratios of the β phase and the γ phase are in the predetermined preferable ranges, the copper alloy sheet is superior in balance between specific strength, elongation, and conductivity and in bending workability.

In addition, since the copper alloy sheet contains either or both of 0.005 mass % to 0.05 mass % of Co and 0.5 mass % to 1.5 mass % of Ni, the crystal grains are refined, and a tensile strength is increased. In addition, stress relaxation characteristics are improved.

In addition, according to still another aspect of the invention, there is provided a copper alloy sheet which is manufactured by a manufacturing process including a finish cold-rolling process of cold-rolling a copper alloy material. In this copper alloy sheet, an average grain size of the copper alloy material is 2.0 μm to 7.0 μm; a sum of an area ratio of a β phase and an area ratio of a γ phase in a metallographic structure of the copper alloy material is 0% to 0.9%; the copper alloy sheet contains 28.0 mass % to 35.0 mass % of Zn, 0.15 mass % to 0.75 mass % of Sn, 0.005 mass % to 0.05 mass % of P, 0.003 mass % to 0.03 mass % of Fe, and a balance consisting of Cu and unavoidable impurities; and a Zn content [Zn] (mass %) and a Sn content [Sn] (mass %) satisfy relationships of $44 \geq [Zn]+20\times[Sn] \geq 37$ and $32 \leq [Zn]+9\times([Sn]-0.25)^{1/2} \leq 37$ (where, when the Sn content is less than or equal to 0.25%, a value of $([Sn-0.25]^{1/2}$ is 0).

According to the aspect of the invention, since the average grain size of the crystal grains in the copper alloy material before finish cold-rolling; and the area ratios of the β phase and the γ phase are in the predetermined preferable ranges, the copper alloy sheet is superior in balance between specific strength, elongation, and conductivity and in bending workability.

Further, since the copper alloy sheet contains 0.003 mass % to 0.03 mass % of Fe, the crystal grains are refined, and a tensile strength is increased. Fe can be used instead of expensive Co.

In addition, according to still another aspect of the invention, there is provided a copper alloy sheet which is manufactured by a manufacturing process including a finish cold-rolling process of cold-rolling a copper alloy material. In this copper alloy sheet, an average grain size of the copper alloy material is 2.0 μm to 7.0 μm; a sum of an area ratio of a β phase and an area ratio of a γ phase in a metallographic structure of the copper alloy material is 0% to 0.9%; the copper alloy sheet contains 28.0 mass % to 35.0 mass % of Zn, 0.15 mass % to 0.75 mass % of Sn, 0.005 mass % to 0.05 mass % of P, 0.003 mass % to 0.03 mass % of Fe, either or both of 0.005 mass % to 0.05 mass % of Co and 0.5 mass % to 1.5 mass % of Ni, and a balance consisting of Cu and unavoidable impurities; and a Zn content [Zn] (mass %) and a Sn content [Sn] (mass %) satisfy relationships of $44 \geq [Zn]+20\times[Sn] \geq 37$ and $32 \leq [Zn]+9\times([Sn]-0.25)^{1/2} \leq 37$ (where, when the Sn content is less than or equal to 0.25%, a value of $([Sn-0.25]^{1/2}$ is 0), and a Co content [Co] (mass %) and a Fe content [Fe] (mass %) satisfy a relationship of [Co]+[Fe]0.04.

According to the aspect of the invention, since the average grain size of the crystal grains in the copper alloy material before finish cold-rolling; and the area ratios of the β phase and the γ phase are in the predetermined preferable ranges, the copper alloy sheet is superior in balance between specific strength, elongation, and conductivity and in bending workability.

In addition, since the copper alloy sheet contains either or both of 0.005 mass % to 0.05 mass % of Co and 0.5 mass % to 1.5 mass % of Ni and 0.003 mass % to 0.03 mass % of Fe, the crystal grains are refined, and a tensile strength is increased. In addition, stress relaxation characteristics are improved.

In the four copper alloy sheets according to the aspects of the invention, when a tensile strength is denoted by A ($N/mm^2$), an elongation is denoted by B (%), a conductivity is denoted by C (% IACS), and a density is denoted by D ($g/cm^3$), after the finish cold-rolling process, $A \geq 540$, $C \geq 21$, and $340 \leq [A\times\{(100+B)/100\}\times C^{1/2}\times 1/D]$.

Since balance between specific strength, elongation, and conductivity is superior, the copper alloy sheets are suitable for components such as a connector, a terminal, a relay, a spring, and a switch.

It is preferable that the manufacturing process of the four copper alloy sheets according to the aspects of the invention include a recovery heat treatment process after the finish cold-rolling process.

Since the recovery heat treatment is performed, the copper alloy sheets are superior in a spring deflection limit, conductivity, and stress relaxation characteristics.

According to still another aspect of the invention, there is provided a method of manufacturing one of the four copper alloy sheets according to the aspects of the invention, the method including, in this order: a hot-rolling process; a first cold-rolling process; an annealing process; a recrystallization heat treatment process; and the finish cold-rolling process. In this method, a hot-rolling start temperature of the hot-rolling process is 760° C. to 850° C.; and a cooling rate of a copper alloy material in a temperature range from 480° C. to 350° C. after final hot-rolling is higher than or equal to 1° C./sec or the copper alloy material is held in a temperature range from 450° C. to 650° C. for 0.5 hours to 10 hours after hot-rolling. In addition, in this method, a cold-rolling ratio in the first cold-rolling process is higher than or equal to 55%; when a maximum reaching temperature of the copper alloy material is denoted by Tmax (° C.), a holding time in a temperature range from a temperature, which is 50° C. lower than the maximum reaching temperature of the copper alloy material, to the maximum reaching temperature is denoted by tm (min), and a cold-rolling ratio in the cold-rolling process is denoted by RE (%), the annealing process satisfies $420 \leq Tmax \leq 720$, $0.04 \leq tm \leq 600$, and $380 \leq \{Tmax-40\times tm^{-1/2}-50\times(1-RE/100)^{1/2}\} \leq 580$, or the annealing process is a batch type annealing at a temperature of 420° C. to 560° C.; the recrystallization heat treatment process includes a heating step of heating the copper alloy material to a predetermined temperature, a holding step of holding the copper alloy material at a predetermined temperature for a predetermined time after the heating step, and a cooling step of cooling the copper alloy material to a predetermined temperature after the holding step; and in the recrystallization heat treatment process, when a maximum reaching temperature of the copper alloy material is denoted by Tmax (° C.), a holding time in a temperature range from a temperature, which is 50° C. lower than the maximum reaching temperature of the copper alloy material, to the maximum reaching temperature is denoted by tm (min), and a cold-rolling ratio in the second cold-rolling process is denoted by RE (%), $480 \leq Tmax \leq 690$, $0.03 \leq tm \leq 1.5$, and $360 \leq \{Tmax-40\times tm^{-1/2}-50\times(1-RE/100)^{1/2}\} \leq 520$.

Depending on the thickness of the copper alloy sheet, during a period between the hot-rolling process and the cold-rolling process, a pair of a cold-rolling process and an annealing process may be performed once or multiple times.

According to still another aspect of the invention, there is provided a method of manufacturing one of the four copper alloy sheets according to the aspects of the invention in which a recovery heat treatment is performed. This method includes, in this order, a hot-rolling process, a first cold-rolling process, an annealing process, a recrystallization heat treatment process, the finish cold-rolling process, and a recovery heat treatment process. In this method, a hot-rolling start temperature of the hot-rolling process is 760° C. to 850° C.; and a cooling rate of a copper alloy material in a temperature range from 480° C. to 350° C. after final hot-rolling is higher than or equal to 1° C./sec or the copper alloy material is held in a temperature range from 450° C. to 650° C. for 0.5 hours to 10 hours after hot-rolling. In addition, in this method, a cold-rolling ratio in the first cold-rolling process is higher than or equal to 55%; when a maximum reaching temperature of the copper alloy material is denoted by Tmax (° C.), a holding time in a temperature range from a temperature, which is 50° C. lower than the maximum reaching temperature of the copper alloy material, to the maximum reaching temperature is denoted by tm (min), and a cold-rolling ratio in the cold-rolling process is denoted by RE (%), the annealing process satisfies $420 \leq Tmax \leq 720$, $0.04 \leq tm \leq 600$, and $380 \leq \{Tmax-40\times tm^{-1/2}-50\times(1-RE/100)^{1/2}\} \leq 580$, or the annealing process is a batch type annealing at a temperature of 420° C. to 560° C.; the recrystallization heat treatment process includes a heating step of heating the copper alloy material to a predetermined temperature, a holding step of holding the copper alloy material at a predetermined temperature for a predetermined time after the heating step, and a cooling step of cooling the copper alloy material to a predetermined temperature after the holding step; in the recrystallization heat treatment process, when a maximum reaching temperature of the copper alloy material is denoted by Tmax (° C.), a holding time in a temperature range from a temperature, which is 50° C.

lower than the maximum reaching temperature of the copper alloy material, to the maximum reaching temperature is denoted by tm (min), and a cold-rolling ratio in the second cold-rolling process is denoted by RE (%), $480 \leq Tmax \leq 690$, $0.03 \leq tm \leq 1.5$, and $360 \leq \{Tmax - 40 \times tm^{-1/2} - 50 \times (1 - RE/100)^{1/2}\} \leq 520$; the recovery heat treatment process includes a heating step of heating the copper alloy material to a predetermined temperature, a holding step of holding the copper alloy material at a predetermined temperature for a predetermined time after the heating step, and a cooling step of cooling the copper alloy material to a predetermined temperature after the holding step; and in the recovery heat treatment process, when a maximum reaching temperature of the copper alloy material is denoted by Tmax2 (° C.), a holding time in a temperature range from a temperature, which is 50° C. lower than the maximum reaching temperature of the copper alloy material, to the maximum reaching temperature is denoted by tm2 (min), and a cold-rolling ratio in the finish cold-rolling process is denoted by RE2(%), $120 \leq Tmax2 \leq 550$, $0.02 \leq tm2 \leq 6.0$, and $30 \leq \{Tmax2 - 40 \times tm2^{-1/2} - 50 \times (1 - RE2/100)^{1/2}\} \leq 250$.

Depending on the thickness of the copper alloy sheet, during a period between the hot-rolling process and the second cold-rolling process, a pair of a cold-rolling process and an annealing process may be performed once or multiple times.

Advantage of the Invention

According to the invention, the copper alloy material is superior in balance between specific strength, elongation, and conductivity and in bending workability.

BEST MODE FOR CARRYING OUT THE INVENTION

Copper alloy sheets according to embodiments of the invention will be described.

In this specification, in order to represent an alloy composition, a parenthesized [ ] chemical symbol for an element, such as [Cu], represents a content value (mass %) of the element. In addition, using this method of representing a content value, plural calculation formulae in the specification will be presented. However, a Co content of 0.001 mass % or less and a Ni content of 0.01 mass % or less have little effect on properties of a copper alloy sheet. Therefore, in the following respective calculation formulae, a Co content of 0.001 mass % or less and a Ni content of 0.01 mass % or less are considered 0 mass %.

In addition, since contents of the respective unavoidable impurities have little effect on properties of a copper alloy sheet, these contents are also not considered in the following respective calculation formulae. For example, 0.01 mass % or less of Cr is considered the unavoidable impurities.

In addition, in this specification, as an index indicating a balance between a Zn content and a Sn content, a first composition index f1 and a second composition index f2 are defined as follows.

First Composition Index $f1 = [Zn] + 20[Sn]$

Second Composition Index $f2 = [Zn] + 9([Sn] - 0.25)^{1/2}$

In these formulae, When the Sn content is less than or equal to 0.25%, a value of $([Sn] - 0.25)^{1/2}$ is 0.

In addition, in this specification, as an index indicating heat treatment conditions in a recrystallization heat treatment process and a recovery heat treatment process, a heat treatment index It is defined as follows.

When a maximum reaching temperature of a copper alloy material in each heat treatment is denoted by Tmax (° C.), a holding time in a temperature range from a temperature, which is 50° C. lower than the maximum reaching temperature of the copper alloy material, to the maximum reaching temperature is denoted by tm (min), and a cold-rolling ratio of cold-rolling which is performed during a period between each heat treatment (the recrystallization heat treatment process or the recovery heat treatment process) and a previous recrystallization treatment (hot-rolling or a heat treatment) of the heat treatment is denoted by RE (%), the heat treatment index It is defined as follows.

Heat Treatment Index $It = Tmax - 40 \times tm^{-1/2} - 50 \times (1 - RE/100)^{1/2}$ In addition, as an index indicating a balance between strength (particularly, specific strength), elongation and conductivity, a balance index fe is defined as follows. When a tensile strength is denoted by A ($N/mm^2$), an elongation is denoted by B (%), a conductivity is denoted by C (% IACS), and a density is denoted by D ($g/cm^3$), the balance index fe is defined as follows.

Balance Index $fe = A \times \{(100 + B)/100\} \times C^{1/2} \times 1/D$

A copper alloy sheet according to a first embodiment is manufactured by finish cold-rolling of a copper alloy material. An average grain size of the copper alloy material is 2.0 μm to 7.0 μm. A sum of an area ratio of a β phase and an area ratio of a γ phase in a metallographic structure of the copper alloy material is 0% to 0.9%, and an occupancy ratio of an α phase is higher than or equal to 99%. The copper alloy sheet contains 28.0 mass % to 35.0 mass % of Zn, 0.15 mass % to 0.75 mass % of Sn, 0.005 mass % to 0.05 mass % of P, and a balance consisting of Cu and unavoidable impurities. A Zn content [Zn] (mass %) and a Sn content [Sn] (mass %) satisfy relationships of $44 \geq [Zn] + 20 \times [Sn] \geq 37$ and $32 \leq [Zn] + 9 \times ([Sn] - 0.25)^{1/2} \leq 37$.

Since the average grain size of the crystal grains in the copper alloy material before finish cold-rolling; and the area ratios of the β phase and the γ phase are in the predetermined preferable ranges, this copper alloy sheet is superior in balance between tensile strength, elongation, and conductivity and in bending workability.

A copper alloy sheet according to a second embodiment is manufactured by finish cold-rolling of a copper alloy material. An average grain size of the copper alloy material is 2.0 μm to 7.0 μm. A sum of an area ratio of a β phase and an area ratio of a γ phase in a metallographic structure of the copper alloy material is 0% to 0.9%, and an occupancy ratio of an α phase is higher than or equal to 99%. The copper alloy sheet contains 28.0 mass % to 35.0 mass % of Zn, 0.15 mass % to 0.75 mass % of Sn, 0.005 mass % to 0.05 mass % of P, either or both of 0.005 mass % to 0.05 mass % of Co and 0.5 mass % to 1.5 mass % of Ni, and a balance consisting of Cu and unavoidable impurities. A Zn content [Zn] (mass %) and a Sn content [Sn] (mass %) satisfy relationships of $44 \geq [Zn] + 20 \times [Sn]n \geq 37$ and $32 \leq [Zn] + 9 \times ([Sn] - 0.25)^{1/2} \leq 37$.

Since the average grain size of the crystal grains in the copper alloy material before finish cold-rolling; and the area ratios of the β phase and the γ phase are in the predetermined preferable ranges, this copper alloy sheet is superior in balance between tensile strength, elongation, and conductivity and in bending workability.

In addition, since the copper alloy sheet contains either or both of 0.005 mass % to 0.05 mass % of Co and 0.5 mass % to 1.5 mass % of Ni, the crystal grains are refined, a tensile strength is increased, and stress relaxation characteristics are improved.

A copper alloy sheet according to a third embodiment is manufactured by finish cold-rolling of a copper alloy material. An average grain size of the copper alloy material is 2.0 μm to 7.0 μm. A sum of an area ratio of a β phase and an area ratio of a γ phase in a metallographic structure of the copper alloy material is 0% to 0.9%, and an occupancy ratio of an α phase is higher than or equal to 99%. The copper alloy sheet contains 28.0 mass % to 35.0 mass % of Zn, 0.15 mass % to 0.75 mass % of Sn, 0.005 mass % to 0.05 mass % of P, 0.003 mass % to 0.03 mass % of Fe, and a balance consisting of Cu and unavoidable impurities. A Zn content [Zn] (mass %) and a Sn content [Sn] (mass %) satisfy relationships of $44 \geq [Zn]+20\times[Sn] \geq 37$ and $32 \leq [Zn]+9\times([Sn]-0.25)^{1/2} \leq 37$.

Since the average grain size of the crystal grains in the copper alloy material before finish cold-rolling; and the area ratios of the β phase and the γ phase are in the predetermined preferable ranges, this copper alloy sheet is superior in balance between specific strength, elongation, and conductivity and in bending workability.

Further, since the copper alloy sheet contains 0.003 mass % to 0.03 mass % of Fe, the crystal grains are refined, and a tensile strength is increased. Fe can be used instead of expensive Co.

A copper alloy sheet according to a fourth embodiment is manufactured by finish cold-rolling of a copper alloy material. An average grain size of the copper alloy material is 2.0 μm to 7.0 μm. A sum of an area ratio of a β phase and an area ratio of a γ phase in a metallographic structure of the copper alloy material is 0% to 0.9%, and an occupancy ratio of an α phase is higher than or equal to 99%. The copper alloy sheet contains 28.0 mass % to 35.0 mass % of Zn, 0.15 mass % to 0.75 mass % of Sn, 0.005 mass % to 0.05 mass % of P, 0.003 mass % to 0.03 mass % of Fe, either or both of 0.005 mass % to 0.05 mass % of Co and 0.5 mass % to 1.5 mass % of Ni, and a balance consisting of Cu and unavoidable impurities. A Zn content [Zn] (mass %) and a Sn content [Sn] (mass %) satisfy relationships of $44 \geq [Zn]+20\times[Sn]n \geq 37$ and $32 \leq [Zn]+9\times([Sn]-0.25)^{1/2} \leq 37$ (where, when the Sn content is less than or equal to 0.25%, a value of $([Sn-0.25]^{1/2}$ is 0), and a Co content [Co] (mass %) and a Fe content [Fe] (mass %) satisfy a relationship of [Co]+[Fe]0.04.

Since the average grain size of the crystal grains in the copper alloy material before finish cold-rolling; and the area ratios of the β phase and the γ phase are in the predetermined preferable ranges, this copper alloy sheet is superior in balance between specific strength, elongation, and conductivity and in bending workability.

In addition, since the copper alloy sheet contains either or both of 0.005 mass % to 0.05 mass % of Co and 0.5 mass % to 1.5 mass % of Ni and 0.003 mass % to 0.03 mass % of Fe, the crystal grains are refined, and a tensile strength is increased. In addition, stress relaxation characteristics are improved.

Next, a preferable manufacturing process of the copper alloy sheet according to any one of the embodiments will be described.

The manufacturing process includes a hot-rolling process, a first cold-rolling process, an annealing process, a second cold-rolling process, a recrystallization heat treatment process, and the above-described finish cold-rolling process in this order. The above-described second cold-rolling process corresponds to the cold-rolling process described in Claims. In each process, a necessary manufacturing condition range is set, and this range will be referred to as a setting condition range.

A composition of an ingot used for hot-rolling is adjusted such that a composition of the copper alloy sheet contains 28.0 mass % to 35.0 mass % of Zn, 0.15 mass % to 0.75 mass % of Sn, 0.005 mass % to 0.05 mass % of P, and a balance consisting of Cu and unavoidable impurities and such that a Zn content [Zn] (mass %) and a Sn content [Sn] (mass %) satisfy relationships of $44 \geq [Zn]+20\times[Sn] \geq 37$ and $32 \leq [Zn]+9\times([Sn]-0.25)^{1/2} \leq 37$. An alloy having this composition will be referred to as a first alloy according to the invention.

In addition, a composition of an ingot used for hot-rolling is adjusted such that a composition of the copper alloy sheet contains 28.0 mass % to 35.0 mass % of Zn, 0.15 mass % to 0.75 mass % of Sn, 0.005 mass % to 0.05 mass % of P, either or both of 0.005 mass % to 0.05 mass % of Co and 0.5 mass % to 1.5 mass % of Ni, and a balance consisting of Cu and unavoidable impurities and such that a Zn content [Zn] (mass %) and a Sn content [Sn] (mass %) satisfy relationships of $44 \geq [Zn]+20\times[Sn]n \geq 37$ and $32 \leq [Zn]+9\times([Sn]-0.25)^{1/2} \leq \leq 37$. An alloy having this composition will be referred to as a second alloy according to the invention.

In addition, a composition of an ingot used for hot-rolling is adjusted such that a composition of the copper alloy sheet contains 28.0 mass % to 35.0 mass % of Zn, 0.15 mass % to 0.75 mass % of Sn, 0.005 mass % to 0.05 mass % of P, 0.003 mass % to 0.03 mass % of Fe, and a balance consisting of Cu and unavoidable impurities and such that a Zn content [Zn] (mass %) and a Sn content [Sn] (mass %) satisfy relationships of $44 \geq [Zn]+20\times[Sn]n \geq 37$ and $32 \leq [Zn]+9\times([Sn]-0.25)^{1/2} \leq \leq 37$. An alloy having this composition will be referred to as a third alloy according to the invention.

In addition, a composition of an ingot used for hot-rolling is adjusted such that a composition of the copper alloy sheet contains 28.0 mass % to 35.0 mass % of Zn, 0.15 mass % to 0.75 mass % of Sn, 0.005 mass % to 0.05 mass % of P, 0.003 mass % to 0.03 mass % of Fe, either or both of 0.005 mass % to 0.05 mass % of Co and 0.5 mass % to 1.5 mass % of Ni, and a balance consisting of Cu and unavoidable impurities and such that a Zn content [Zn] (mass %) and a Sn content [Sn] (mass %) satisfy relationships of $44 \geq [Zn]+20\times[Sn]n \geq 37$ and $32 \leq [Zn]+9\times([Sn]-0.25)^{1/2} \leq 37$, and a Co content [Co] (mass %) and a Fe content [Fe] (mass %) satisfy a relationship of [Co]+[Fe]0.04. An alloy having this composition will be referred to as a fourth alloy according to the invention.

The first, second, third, and fourth alloys according to the invention will be collectively referred to as the alloys according to the invention.

A hot-rolling start temperature of the hot-rolling process is 760° C. to 850° C., and the hot-rolling process includes a heat treatment process in which a cooling rate of a rolled material in a temperature range from 480° C. to 350° C. after final hot-rolling is higher than or equal to 1° C./sec. Alternatively, the hot-rolling process includes a heat treatment process in which the rolled material is held in a temperature range from 450° C. to 650° C. for 0.5 hours to 10 hours after hot-rolling.

In the first cold-rolling process, a cold-rolling ratio is higher than or equal to 55%.

As described below, the annealing process satisfies a condition of $H0 \leq H1\times4(RE/100)$ when a grain size after the recrystallization heat treatment process is denoted by H1, a grain size after the annealing process prior to the recrystallization heat treatment process is denoted by H0, and a cold-rolling ratio of the second cold-rolling process between the recrystallization heat treatment process and the annealing process is denoted by RE(%). Regarding this condition, for example, in a case where the annealing process includes a heating step of heating the copper alloy material to a predetermined temperature, a holding step of holding the copper alloy material at a predetermined temperature for a predetermined time after the heating step, and a cooling step of cooling the copper alloy material to a predetermined temperature after the holding step, when a maximum reaching temperature of the copper alloy material is denoted by Tmax (° C.), a holding time in a temperature range from a temperature, which is 50° C. lower than the maximum reaching temperature of the copper alloy material, to the maximum reaching temperature is denoted by tm (min), and a cold-rolling ratio in the first cold-rolling process is denoted by RE (%), $420 \leq Tmax \leq 720$, $0.04 \leq tm \leq 600$, and $380 \leq \{Tmax - 40 \times tm^{-1/2} - 50 \times (1 - RE/100)^{1/2}\} \leq 580$. In addition, in the case of batch type annealing, tm is usually is longer than or equal to 60. Therefore, it is preferable that a holding time after a predetermined temperature is reached be 1 hour to 10 hours and that an annealing temperature be 420° C. to 560° C.

When the thickness of a rolled sheet after the finish cold-rolling process is large, the first cold-rolling process and the annealing process may not be performed. When the thickness of a rolled sheet after the finish cold-rolling process is small, the first cold-rolling process and the annealing process may be performed multiple times. When occupancy ratios of a β phase and a γ phase in a metallographic structure after hot-rolling (for example, when a sum of area ratios of (3 and γ phases is higher than or equal to 1.5%, particularly, higher than or equal to 2%), in order to reduce the amounts of the β phase and the γ phase, it is preferable that a hot-rolled material be annealed in a temperature range from 450° C. to 650° C., preferably, from 480° C. to 620° C. for 0.5 hours to 10 hours after the first cold-rolling process and the annealing process or after hot-rolling. Originally, a grain size of a hot-rolled material is 0.02 mm to 0.03 mm, the growth of crystal grains is small even when being heated to 550° C. to 600° C., and α phase change rate is low in the hot rolling-finished state. That is, since α phase change from a β phase or a γ phase to an α phase is difficult to occur, it is necessary that the temperature be set to be high. Alternatively, in the annealing process, in order to reduce occupancy ratios of β and γ phases in a metallographic structure, in the case of short-period annealing where $0.05 \leq tm \leq 6.0$, it is preferable that $500 \leq Tmax \leq 700$ and $440 \leq (Tmax - 40 \times tm^{-1/2} - 50 \times (1 - RE/100)^{1/2}) \leq 580$. In the case of batch type annealing, it is preferable that $380 \leq (Tmax - 40 \times tm^{-1/2} - 50 \times (1 - RE/100)^{1/2}) \leq 540$ under conditions of a heating holding time of 1 hour to 10 hours and an annealing temperature of 420° C. to 560° C. For example, when a material having a high cold-rolling ratio is annealed for a short period of time, α phase change from a β phase or a γ phase to an α phase is likely to occur under heating conditions of a temperature of 500° C. or higher and an It value of 440 or greater. In addition, when a material having a high cold-rolling ratio is annealed for a long period of time of 1 hour or longer, a phase change from a β phase or a γ phase to an α phase is likely to occur under heating conditions of a temperature of 420° C. or higher and an It value of 380 or greater. In the recrystallization heat treatment, it is important to obtain predetermined fine crystal grains. Therefore, in a main annealing process which is the previous process, a final desired composition ratio of phases, that is, a sum of area ratios of β and γ phases be set to be preferably lower than or equal to 1.0% and more preferably lower than or equal to 0.6%. In this case, it is necessary that the grain size H0 after the annealing process be controlled so as to satisfy $H0 \leq H1 \times 4(RE/100)$ described above. Since Co or Ni described below has an effect of suppressing grain growth even at a high annealing temperature, the addition of Co or Ni is effective. Whether or not to perform the first cold-rolling process and the annealing process and the number of times of operations thereof are determined based on a relationship between the thickness after the hot-rolling process and the thickness after the finish cold-rolling process.

In the second cold-rolling process, a cold-rolling ratio is higher than or equal to 55%.

The recrystallization heat treatment process includes a heating step of heating the copper alloy material to a predetermined temperature, a holding step of holding the copper alloy material at a predetermined temperature for a predetermined time after the heating step, and a cooling step of cooling the copper alloy material to a predetermined temperature after the holding step.

In this case, when a maximum reaching temperature of the copper alloy material is denoted by Tmax (° C.) and a holding time in a temperature range from a temperature, which is 50° C. lower than the maximum reaching temperature of the copper alloy material, to the maximum reaching temperature is denoted by tm (min), the recrystallization heat treatment process satisfies the following conditions.

$$480 \leq \text{Maximum Reaching Temperature } Tmax \leq 690 \quad (1)$$

$$0.03 \leq \text{Holding Time } tm \leq 1.5 \quad (2)$$

$$360 \leq \text{Heat Treatment Index } It \leq 520 \quad (3)$$

As described below, there is a case where the recovery heat treatment process may be performed after the recrystallization heat treatment process. However, the recrystallization heat treatment process is the final heat treatment of recrystallizing the copper alloy material.

After the recrystallization heat treatment process, the copper alloy material has an average grain size of 2.0 μm to 7.0 μm, a sum of an area ratio of a β phase and an ratio of a γ phase in a metallographic structure of 0% to 0.9%, and an occupancy ratio of an α phase in the metallographic structure of 99% or higher.

In the finish cold-rolling process, a cold-rolling ratio is 5% to 45%.

After the finish cold-rolling process, the recovery heat treatment may be performed. In addition, depending on uses of the copper alloys according to the invention, Sn plating is performed after finish rolling. In this case, since a material temperature is increased during plating such as hot dip Sn plating or reflow Sn plating, a heating process during plating can be performed instead of the recovery heat treatment process according to the invention.

The recovery heat treatment process includes a heating step of heating the copper alloy material to a predetermined temperature, a holding step of holding the copper alloy material at a predetermined temperature for a predetermined time after the heating step, and a cooling step of cooling the copper alloy material to a predetermined temperature after the holding step.

In this case, when a maximum reaching temperature of the copper alloy material is denoted by Tmax (° C.) and a holding time in a temperature range from a temperature, which is 50° C. lower than the maximum reaching temperature of the copper alloy material, to the maximum reaching temperature is denoted by tm (min), the recrystallization heat treatment process satisfies the following conditions.

$$120 \leq \text{Maximum Reaching Temperature } Tmax \leq 550 \quad (1)$$

$$0.02 \leq \text{Holding Time } tm \leq 6.0 \quad (2)$$

$$30 \leq \text{Heat Treatment Index } It \leq 250 \quad (3)$$

Next, the reason for the addition of each element will be described.

Zn is a major element constituting the alloys according to the invention, is divalent, decreases a stacking fault energy, increases nucleation sites of recrystallization nuclei during annealing, and refines or ultra-refines recrystallized grains. In addition, the solid-soluting of Zn improves a strength such as a tensile strength or a proof strength, improves heat resistance of a matrix, and improves migration resistance. Zn has a low metal cost and an effect of reducing a specific gravity and a density of a copper alloy. Specifically, since the addition of an appropriate amount of Zn reduces a specific gravity of a copper alloy to be less than 8.55 g/cm$^3$, there is a large economic advantage. Although depending on a relationship with other added elements such as Sn, it is necessary that the Zn content be at least greater than or equal to 28 mass % and preferably greater than or equal to 29 mass % in order to exhibit the above-described effects. On the other hand, although depending on a relationship with other added elements such as Sn, even when the Zn content is greater than 35 mass %, the effects of refining crystal grains and improving a strength cannot be obtained correspondingly to the Zn content. In addition, β and γ phases in a metallographic structure, which deteriorates elongation, bending workability, and stress relaxation characteristics, exceed an allowable limit, that is, an sum of area ratios of the β phase and the γ phase in the metallographic structure is higher than 0.9%. The Zn content is more preferably less than or equal to 34 mass % and most preferably less than or equal to 33.5 mass %. Even when the content of Zn which is divalent is in the above-described range, it is difficult to refine crystal grains with the addition of Zn alone. In order to refine crystal grains to a predetermined grain size and to increase a strength by solid solution strengthening of Zn and Sn, it is necessary that Sn be also added as described below and that the first composition index f1 and the second composition index f2 be in the following appropriate ranges ($f1=[Zn]+20[Sn]$, $f2=[Zn]+9([Sn]-0.25)^{1/2}$).

Sn is a major element constituting the alloys according to the invention, is tetravalent, decreases a stacking fault energy, increases nucleation sites of recrystallization nuclei during annealing in combination with the addition of Zn, and refines or ultra-refines recrystallized grains. Particular, when Sn is added along with the addition of 28 mass % or greater, preferably, 29 mass % or greater of divalent Zn, these effects are significantly exhibited even with the addition of a small amount of Sn. In addition, Sn is solid-soluted in a matrix so as to improve a strength such as a tensile strength, a proof strength, or a spring deflection limit. In addition, Sn also improves stress relaxation characteristics due to a synergistic effect with Zn, relational expressions of f1 and f2 described below, P, Co, and Ni. In order to exhibit these effects, the Sn content is necessarily greater than or equal to 0.15 mass %, preferably greater than or equal to 0.2 mass %, and most preferably greater than or equal to 0.25 mass %. On the other hand, although depending on a relationship with other elements such as Zn, when the Sn content is greater than 0.75 mass %, conductivity deteriorates. In some cases, the conductivity of a copper alloy may be decreased to approximately 21% IACS which is ⅕ of the conductivity of pure copper. In addition, bending workability deteriorates. Further, although depending on the Zn content, Sn has an effect of promoting the formation of a γ phase and a β phase and stabilizing a γ phase and a β phase. When even small amounts of β and γ phases are present in a metallographic structure, there is an adverse effect on elongation and bending workability. Therefore, it is necessary that a sum of area ratios of β and γ phases in a metallographic structure be lower than or equal to 0.9%. Regarding Zn and Sn, according to characteristics of the alloys according to the invention which are manufactured in consideration of the interaction between ZN and Sn under appropriate manufacturing conditions with a optimum mixing ratio satisfying f1 and f2 described below, an occupancy ratio of an α phase in a metallographic structure is higher than or equal to 99%, and a sum of area ratios of β and γ phases is 0% to 0.9%. In this case, a metallographic structure in which a sum of area ratios of β and γ phases is 0% or extremely close to 0% is more preferable. Accordingly, in consideration of the fact that Sn is an expensive element, the Sn content is preferably less than or equal to 0.72 mass % and more preferably less than or equal to 0.69 mass %.

Cu is a major element constituting the alloys according to the invention and thus is a balance. When the alloys according to the invention are manufactured, in order to achieve a desired density and superior cost performance while maintaining a strength and elongation which depend on the Cu content, the Cu content is preferably greater than or equal to 65 mass %, more preferably greater than or equal to 65.5 mass %, and still more preferably greater than or equal to 66 mass %. The upper limit of the Cu content is preferably less than or equal to 71.5 mass % and more preferably less than or equal to 71 mass %.

P is pentavalent and has an effect of refining crystal grains and an effect of suppressing the growth of recrystallized grains, but the latter effect is high due to its small content. A part of P is combined with Co or Ni described below to form a precipitate, and the grain growth suppressing effect can be further strengthened. In addition, P also improves stress relaxation characteristics due to the compound formation with Co and the like or due to a synergic effect with solid-soluting Ni. In order to exhibit the grain growth suppressing effect, the P content is necessarily greater than or equal to 0.005 mass %, preferably greater than or equal to 0.008 mass %, and most preferably greater than or equal to 0.01 mass %. Particularly, in order to improve stress relaxation characteristics, the P content is preferably greater than or equal to 0.01 mass %. On the other hand, when the P content is greater than 0.05 mass %, the recrystallized grain growth suppressing effect by P alone or a precipitate of P and Co is saturated. Conversely, when a large amount of precipitate is present, elongation and bending workability deteriorate. Therefore, the P content is preferably less than or equal to 0.04 mass % and most preferably less than or equal to 0.035 mass %.

Co is bonded with P to form a compound. The compound of P and Co suppresses the growth of recrystallized grains. In addition, this compound prevents deterioration in stress relaxation characteristics caused by grain refinement. In order to exhibit the effects, the Co content is necessarily greater than or equal to 0.005 mass % and preferably greater than or equal to 0.01 mass %. On the other hand, when the Co content is greater than or equal to 0.05 mass %, the effects are saturated. In addition, depending on the process, elongation and bending workability may be decreased by precipitate particles of Co and P. The Co content is preferably less than or equal to 0.04 mass % and most preferably less than or equal to 0.03 mass %. The effect of suppressing recrystallized grain growth by Co is effective for a case where β and γ phases in the composition are precipitated in large amounts and remain in a rolled material. This is because fine recrystallized grains can be maintained as they are, for example, in the annealing process, even when the annealing temperature is high and the annealing time is long or even when the heat treatment index It is great. According to the invention, one of the most important factors is that a sum of area ratios of β and γ phases is less than or equal to 0.9%. In order to reduce β and γ phases to a predetermined ratio, it is necessary that, for example, during annealing, the temperature be higher than or equal to 420° C.

in the case of a batch type heat treatment and be higher than or equal to 500° C. in the case of a short-period heat treatment. Contradiction between the grain refinement and the decrease in the amounts of β and γ phases can be solved by the addition of Co.

Ni is an expensive metal but has an effect of suppressing grain growth by forming a precipitate when Ni and P are added together, an effect of improving stress relaxation characteristics by precipitate formation, and a effect of improving stress relaxation characteristics by a synergistic effect between Ni and Sn in the solid solution state; and P. When crystal grains are refined or ultra-refined, stress relaxation characteristics of a copper alloy deteriorate. However, Co and Ni which form a compound with P have an effect of suppressing deterioration in stress relaxation characteristics to the minimum. Further, when a large amount of Zn is added, stress relaxation characteristics of a copper alloy deteriorate. However, stress relaxation characteristics are improved to a large degree by a synergistic effect between Ni and Sn in the solid solution state; and P. Specifically, even in a case where the Zn content is greater than or equal to 28 mass %, when the addition amount of Sn and the relational expressions of the composition indices f1 and f2 satisfy the ranges of the alloys according to the invention, stress relaxation characteristics can be improved by setting the Ni content to be greater than or equal to 0.5 mass %. The Ni content is preferably greater than or equal to 0.6 mass %. In addition, when the Zn content is greater than or equal to 28 mass %, in order to form a compound of Ni and P which suppresses grain growth, the Ni content is preferably greater than or equal to 0.5 mass %. On the other hand, when the Ni content is greater than or equal to 1.5 mass %, the effect of improving stress relaxation characteristics is saturated, conductivity deteriorates, and there is an economic disadvantage. The Ni content is preferably less than or equal to 1.4 mass %. As in the case of the addition of Co, the addition of Ni is effective for achieving, by the grain growth suppressing effect, a predetermined sum of area ratios of β and γ phases and a predetermined grain size of fine or ultra-fine recrystallized grains in the annealing process and the recrystallization heat treatment process.

In order to improve stress relaxation characteristics or obtain the grain growth suppressing effect without deteriorating other properties, the interaction between Ni and P, that is, a mixing ratio of Ni and P is important. That is, it is preferable that $15 \leq Ni/P \leq 85$. When Ni/P is higher than 85, the effect of improving stress relaxation characteristics is decreased. When Ni/P is lower than 15, the effect of improving stress relaxation characteristics and the grain growth suppressing effect are saturated, and bending workability deteriorates.

Incidentally, in order to obtain a high balance between strength, elongation, conductivity, and stress relaxation characteristics, it is necessary that not only the mixing ratio of Zn and Sn but also mutual relationships between the respective elements and a metallographic structure be considered. It is necessary to consider the following factors: high-strengthening by grain refinement which is obtained by the addition of large amounts of divalent Zn and tetravalent Sn decreasing a stacking fault energy; deterioration in elongation by grain refinement; solid solution strengthening by Sn and Zn; deterioration in elongation and bending workability by the presence of β and γ phases in a metallographic structure; and the like. As a result of the study, the present inventors found that each element should satisfy $44 \geq f1 \geq 37$ and $32 \leq f2 \leq 37$ in a composition range of the alloys according to the invention. By satisfying this relationship, an appropriate metallographic structure is obtained, and a material having a high strength, a high elongation, a satisfactory conductivity, stress relaxation characteristics, and a high balance between these properties can be manufactured.

That is, in a rolled material after the finish cold-rolling process, it is necessary that the Zn content be 28 mass % to 35 mass %, the Sn content be 0.15 mass % to 0.75 mass %, and $f1 \geq 37$ be satisfied, in order to obtain the following properties: a high conductivity of 21% IACS or higher; a high strength, for example, a tensile strength of 540 N/mm$^2$ higher (preferably 570 N/mm$^2$ or higher) or a proof strength of 490 N/mm$^2$ or higher (preferably 520 N/mm$^2$ or higher); fine crystal grains; high elongation; and a high balance between these properties. f1 relates to solid solution strengthening by Zn and Sn; work hardening by final finish cold-rolling; and stress relaxation characteristics by grain refinement including the interaction between Zn and Sn and synergistic effects between P, Ni, and Co and between Zn and Sn. In order to obtain a higher strength, it is necessary that f1 be greater than or equal to 37. In order to obtain a higher strength and finer crystal grains and to improve stress relaxation characteristics, f1 is preferably greater than or equal to 37.5 and more preferably greater than or equal to 38. On one hand, in order to improve bending workability, conductivity, and stress relaxation characteristics and to obtain a metallographic structure in which a sum of occupying area ratios of β and γ phases is 0% to 0.9%, f1 is necessarily less than or equal to 44, preferably less than or equal to 43, and more preferably less than or equal to 42. On the other hand, in an actual operation, in order to secure satisfactory elongation, bending workability, and conductivity by setting to an occupying area ratio of (β phase+γ phase) to be 0% to 0.9% in an α phase matrix, it is necessary that f237, which is experimentally obtained, be satisfied, it is preferable that f2 be less than or equal to 36, and it is more preferable that f2 be less than or equal to 35.5. Moreover, in order to obtain a high strength, f2 is preferably greater than or equal to 32 and more preferably greater than or equal to 33. An appropriate adjustment of the Sn content is necessary according to a change in the Zn content. When f1 and f2 are preferable numerical values, a more preferable metallographic structure in which a sum of area ratios of β and γ phases is 0 or extremely close to 0 can be obtained. In the relational expressions of f1 and f2, there are no items for Co and Ni in the relational expression because Co is used in a small amount, forms a precipitate with P, and has little effect on the relational expressions; and Ni can be considered to be substantially the same as Cu during the formation of a precipitate and in the relational expressions of f1 and f2.

Regarding the ultra-refinement of crystal grains, recrystallized grains of an alloy which is in the composition range of the alloys according to the invention can be ultra-refined to 1 μm. However, when the crystal grains of the alloy are refined to 1.5 μm or 1 μm, an occupancy ratio of a grain boundary which is formed with the width corresponding to several atoms is increased. As a result, by work hardening in the final finish cold-rolling process, a high strength is obtained, but elongation and bending workability deteriorate. Accordingly, in order to obtain both a high strength and a high elongation, the average grain size after the recrystallization heat treatment process is necessarily greater than or equal to 2 μm and more preferably greater than or equal to 2.5 μm. On the other hand, as the grain size is increased, a more satisfactory elongation is obtained, but a desired tensile strength and a desired proof strength cannot be obtained. The average grain size is necessarily less than or equal to 7 μm. The average grain size is more preferably less than or equal to 6 μm and still more preferably less than or equal to 5.5 μm. For stress relaxation characteristics, it is preferable that the average grain size be slightly great and, for example, preferably greater than or equal to 3 μm and more preferably greater than or equal to 3.5 μm. The upper limit is less than or equal to 7 μm and preferably less than or equal to 6 μm.

In addition, during the annealing of a rolled material which is cold-rolled at a cold-rolling ratio of, for example, 55% or higher, although also depending on a time period, when the temperature exceeds a critical temperature, recrystallized nuclei are formed centering on a grain boundary where processing strains are accumulated. Although also depending on an alloy composition, in the case of the alloys according to the invention, a grain size of recrystallized grains which are formed after nucleation is less than or equal to 1 μm or is less than or equal to 1.5 μm. However, even when heat is applied to a rolled material, the entire processed structure is not replaced with recrystallized grains. In order to replace 100% or, for example, 97% or higher of the structure with recrystallized grains, a temperature further higher than a start temperature of recrystallization nucleation or a time further longer than a start time of recrystallization nucleation is necessary. During this annealing, recrystallized grains which are initially formed are grown along with an increase in temperature and time, and a grain size thereof is increased. In order to maintain a fine recrystallized grain size, it is necessary that the growth of recrystallized grains be suppressed. In order to achieve this object, P is added and, optionally, Co or Ni is further added. In order to suppress the growth of recrystallized grains, a pin-like material for suppressing the growth of recrystallized grains is necessary. In the invention, this pin-like material corresponds to a compound formed from P or from P and Co or Ni. This compound is optimum to function as a pin. P has a relatively mild grain growth suppressing effect and is appropriate for the alloys according to the invention because the invention does not aim at ultra-refinement of an average grain size of 2 um or less. When Co is further added, a formed precipitate exhibits a large grain growth suppressing effect. In order to form a precipitate with P, Ni requires a greater amount than that of Co, and this precipitate has a small grain growth suppressing effect. However, Ni promotes crystal grains to be in a desired grain size of the invention. In addition, the invention does not aim at large precipitation hardening and, as described above, does not aim at ultra-refinement of crystal grains. Therefore, the Co content is sufficient at an extremely low content of 0.005 mass % to 0.05 mass %, most preferably 0.035 mass % or less. In the case of Ni, a content of 0.5 mass % to 1.5 mass % is required, and Ni not contributing to the formation of a precipitate is used for improving stress relaxation characteristics to a large degree. A precipitate which is formed from Co or from Ni and P in the composition ratio of the alloys according to the invention does not greatly deteriorate bending workability. However, along with an increase in precipitation amount, the precipitate has a larger effect on elongation and bending workability. In addition, when the precipitation amount is great or the particle size of the precipitate is small, the effect of suppressing recrystallized grain growth is excessive, and it is difficult to obtain a desired grain size.

Incidentally, the effect of suppressing grain growth and the effect of improving stress relaxation characteristics depend on the kind, amount, and size of the precipitate. The kind of the precipitate is determined from P and Co or Ni as described above, and the amount of the precipitate is determined from the contents of these elements. Meanwhile, regarding the size of the precipitate, in order to sufficiently exhibit the grain growth suppressing effect and the stress relaxation characteristic improving effect, the average grain size of the precipitate is necessarily 4 nm to 50 nm. When the average grain size of the precipitate is less than 4 nm, the grain growth suppressing effect is excessive. Therefore, it is difficult to obtain a desired recrystallized grain which is defined in the present application, and bending workability deteriorates. The average grain size is preferably greater than or equal to 5 nm. A precipitate of Co and P has a small size. When the average grain size of the precipitate is greater than 50 nm, the grain growth suppressing effect is decreased. Therefore, recrystallized grains are grown, recrystallized grains having a desired size cannot be obtained, and a mixed grain state is likely to occur in some cases. The average grain size is preferably less than or equal to 45 nm. When the precipitate is excessively great, bending workability deteriorates.

In order to suppress grain growth, the addition of P or the addition of P and Co or Ni is optimum. For example, P and Fe or P and other elements such as Mn, Mg, and Cr form a compound, and when the amount of this compound is greater than or equal to a certain value, elongation and the like may deteriorate due to the excessive grain growth suppressing effect and the coarsening of the compound.

When Fe has an appropriate content and an appropriate relationship with Co, Fe has the same function as a precipitate of Co, that is, exhibits the grain growth suppressing function and the stress relaxation characteristic improving function, and can be used instead of Co. That is, the Fe content is necessarily greater than or equal to 0.003 mass % and preferably greater than or equal to 0.005 mass %. On the other hand, when the Fe content is greater than or equal to 0.03 mass %, the effects are saturated, and the grain growth suppressing effect is excessive. As a result, fine crystal grains having a predetermined grain size cannot be obtained, and elongation and bending workability deteriorate. The Fe content is preferably less than or equal to 0.025 mass % and most preferably less than or equal to 0.02 mass %. When Fe and Co are added together, a sum of contents of Fe and Co is necessarily less than or equal to 0.04 mass %. This is because the grain growth suppressing effect is excessive.

Accordingly, it is necessary that the contents of elements other than Fe, such as Cr, be controlled so as not to affect the properties. As conditions of the contents, it is necessary that each content be at least less than or equal to 0.02 mass % and preferably less than or equal to 0.01 mass %; or a sum of contents of elements such as Cr which are combined with P is less than or equal to 0.03 mass %. In addition, when Fe and Co are added together, it is necessary that a sum of contents of Co and the elements such as Cr be less than or equal to 0.04 mass % or be less than or equal to ⅔ of the content of Co and preferably less than or equal to ½ thereof. Changes in the composition, structure, and size of the precipitate have a large effect on elongation and stress relaxation characteristics.

Further, in the finish cold-rolling process, for example, by applying a rolling ratio of 10% to 35%, a tensile strength and a proof strength can be increased due to work hardening by rolling, without a significant deterioration in elongation, that is, at least without cracking at a R/t value (where R represents a curvature radius of a bent portion, and t represents the thickness of a rolled material) of 1 or less during W-bending.

As an index indicating an alloy having a high balance between strength (particularly, specific strength), elongation, and conductivity, the alloy can be evaluated based on the fact that a product of the above-described properties is high. When a tensile strength is denoted by A ($N/mm^2$), an elongation is denoted by B (%), a conductivity is denoted by C (% IACS), and a density is denoted by D, in a final rolled material or a rolled material subjected to low-temperature annealing after rolling, cracking does not occur at least at R/t=1 (where R represents a curvature radius of a bent portion, and t represents the thickness of a rolled material) in a W-bending test, and a product of A, (100+B)/100, $C^{1/2}$, and 1/D is greater than or equal to 340 on the condition that the tensile strength is greater than or equal to 540 N/mm$^2$ and the conductivity is greater than or equal to 21% IACS. In order to obtain a higher balance, the product of A, (100+B)/100, $C^{1/2}$, and 1/D is preferably greater than or equal to 360. Alternatively, during usage, there are many cases where a proof strength is emphasized rather than a tensile strength. Therefore by using a proof strength A1 instead of the tensile strength A, a product of A1, (100+B)/100, $C^{1/2}$, and 1/D is preferably greater than or equal to 315 and more preferably greater than or equal to 330.

As in the case of the invention, when Sn is added to an alloy containing 28% to 35% of Zn, the alloy has a metallographic structure containing β and γ phases in the casting step and the hot-rolling step. Therefore, a method of controlling β and γ phases during a manufacturing process is important. Regarding the manufacturing process, a hot-rolling start temperature is higher than or equal to 760° C. and preferably higher than or equal to 780° C. from the viewpoints of reducing hot deformation resistance and improving hot deformability. The upper limit is lower than or equal to 850° C. and preferably lower than or equal to 840° C. because a large amount of β phase remains at an excessively high temperature. In addition, after completion of final hot-rolling, it is preferable that a heat treatment of cooling a rolled material at a cooling rate of 1° C./sec or higher in a temperature range from 480° C. to 350° C.; or a heat treatment of holding a rolled material in a temperature range from 450° C. to 650° C. for 0.5 hours to 10 hours be performed after hot rolling.

After completion of hot-rolling, when a copper alloy material is cooled at a cooling rate of 1° C./sec or lower in a temperature range from 480° C. to 350° C., a β phase remains in the rolled material immediately after hot-rolling, but the β phase is changed into a γ phase during cooling. When the cooling rate is lower than 1° C./sec, the amount of the β phase changed into the γ phase is increased, and a large amount of γ phase remains after final recrystallization annealing. The cooling rate is preferably higher than or equal to 3° C./sec. In addition, although the cost is high, by performing the heat treatment at 450° C. to 650° C. for 0.5 hours to 10 hours after hot-rolling, β and γ phases in a hot-rolled material can be decreased. In a temperature range lower than 450° C., since α phase change is difficult to occur and a γ phase is stable, it is difficult to decrease a γ phase in a large amount. On the other hand, when the heat treatment is performed at a temperature greater than 650° C., a β phase is stable, it is difficult to decrease a β phase in a large amount, and a grain size may be great at 0.1 mm in some cases. Therefore, even if crystal grains are refined during final recrystallization annealing, a mixed grain state occurs, and elongation and bending workability deteriorate. The temperature of the heat treatment is preferably higher than or equal to 480° C. and lower than or equal to 620° C.

In the recrystallization heat treatment process, a cold-rolling ratio before the recrystallization heat treatment process is higher than or equal to 55%, a maximum reaching temperature is 480° C. to 690° C., a holding time in a range from "maximum reaching temperature −50° C." to the maximum reaching temperature is 0.03 minutes to 1.5 minutes, and the heat treatment index It satisfies 360≤It≤520.

In order to obtain desired fine recrystallized grains in the recrystallization heat treatment process, only a decrease in stacking fault energy is not sufficient. Therefore, in order to increase nucleation sites of recrystallization nuclei, it is necessary that strains by cold-rolling, specifically, strains in a grain boundary be accumulated. To that end, a cold-rolling ratio during cold-rolling prior to the recrystallization heat treatment process is necessarily higher than or equal to 55%, preferably higher than or equal to 60%, and most preferably higher than or equal to 65%. On the other hand, when the cold-rolling ratio during cold-rolling prior to the recrystallization heat treatment process is excessively increased, there are problems in the shape of a rolled material and strains. Therefore, the cold-rolling ratio is preferably lower than or equal to 95% and most preferably lower than or equal to 92%. That is, in order to increase nucleation sites of recrystallization nuclei through a physical action, an increase in cold-rolling ratio is effective. By applying a high rolling ratio in a range where product strains are allowable, finer recrystallized grains can be obtained.

In order to obtain a final desired grain size of fine and uniform crystal grains, it is necessary that a relationship between a grain size after the annealing process, which is a heat treatment prior to the recrystallization heat treatment process, and a rolling ratio of the second cold-rolling process before the recrystallization heat treatment process be defined. That is, it is preferable that H0≤H1×4(RE/100) in a RE range is from 55 to 95 when a grain size after the recrystallization heat treatment process is denoted by H1, a grain size after the annealing process prior to the recrystallization heat treatment process is denoted by H0, and a cold-rolling ratio of the cold-rolling process between the annealing process and the recrystallization heat treatment process is denoted by RE(%). This expression can be applied in a RE range from 40 to 95. In order to obtain a fine grain size of crystal grains and obtain a fine and uniform grain size of recrystallized grains after the recrystallization heat treatment process, it is preferable that a grain size after the annealing process be less than or equal to a product of a value four times a grain size after the recrystallization heat treatment process and RE/100. As the cold-rolling ratio is higher, nucleation sites of recrystallization nuclei are increased. Therefore, even when a grain size after the annealing process is three times or more a grain size after the recrystallization heat treatment process, fine and more uniform recrystallized grains can be obtained. When crystal grains are in a mixed grain size state, that is, are non-uniform, the properties such as bending workability deteriorate.

Conditions of the annealing process are 420≤Tmax≤720, 0.04≤tm≤600, and $380 \leq \{Tmax-40\times tm^{-1/2}-50\times(1-RE/100)^{1/2}\} \leq 580$. When a sum of area ratios of a β phase and a γ phase in a metallographic structure before the annealing process is high, for example, is higher than or equal to 1.5%, particularly, is higher than or equal to 2%, it is necessary that the area ratios of the β phase and the 7 phase be decreased in advance in the annealing process. A sum of area ratios of a β phase and a γ phase in a metallographic structure before the recrystallization heat treatment process be preferably lower than or equal to 1.0% and more preferably lower than or equal to 0.6%. This is because, in the recrystallization heat treatment process, it is important to refine crystal grains to a predetermined grain size, and it is difficult to simultaneously satisfy both the refinement of crystal grains and an optimum constituent phase of a metallographic structure. Conditions of the annealing process are preferably 500≤Tmax≤700, 0.05≤tm≤6.0, $440 \leq \{Tmax-40\times tm^{-1/2}-50\times(1-RE/100)^{1/2}\} \leq 580$. When annealing is performed for a long period of time of 1 hour or longer or of 10 hours or longer, β and γ phases can be decreased by heating under conditions of a temperature of 420° C. or higher (preferably 440° C. or higher) and 560° C. or lower and 380≤It≤540. On the other hand, for example, when It is greater than 580 or greater than 540, the amount of a p phase is not decreased, and crystal grains are grown. In addition, when the temperature is higher than 560° C. during long-period annealing, crystal grains are grown, and $H0 \leq H1 \times 4(RE/100)$ cannot be satisfied. In such a case, even when It or the annealing temperature is high, Co or Ni is effective due to the effect of suppressing grain growth.

In the recrystallization heat treatment process, a short-period heat treatment is preferable, it is preferable that a maximum reaching temperature be 480° to 690° and a holding time in a range from "maximum reaching temperature-50° C." to the maximum reaching temperature be 0.03 minutes to 1.5 minutes, and it is more preferable that a maximum reaching temperature be 490° to 680° and a holding time in a range from "maximum reaching temperature-50° C." to the maximum reaching temperature be 0.04 minutes to 1.0 minute. As specific conditions, it is necessary that a relationship of $360 \leq It \leq 520$ be satisfied. Regarding It, the lower limit is preferably greater than or equal to 380 and more preferably greater than or equal to 400, and the upper limit is less than or equal to 510 and more preferably less than or equal to 500.

When It falls below the lower limit, non-recrystallized portions remain or a grain size is less than that which is defined in the invention. In short-period recrystallization annealing at 480° C. or lower, since the temperature is low and the time period is short, β and γ phases in the non-equilibrium state are not easily changed to an α phase. In addition, in a temperature range of 420° C. or lower or of 440° C. or lower, since a γ phase is more stable, α phase change from a γ phase to an α phase is difficult to occur. When the maximum reaching temperature is higher than 690° C. or It is greater than the upper limit during annealing, the grain growth suppressing effect by P does not function. In addition, when Co or Ni is added, the solid-soluting of a precipitate occurs again, the predetermined effect of suppressing grain growth does not function, and predetermined fine crystal grains cannot be obtained. In addition, in the processes until the recrystallization heat treatment process, a β phase is non-equilibrium and remains in an excess amount. When the maximum reaching temperature is higher than 690° C., the β phase is in a more stable state, and it is difficult to decrease the β phase. When the manufacturing process includes the annealing process, a grain size in the annealing process may be 3 μm to 12 μm and preferably 3.5 μm to 10 μm. Therefore, it is preferable that annealing be performed under annealing conditions that can sufficiently decrease β and γ phases. That is, in the annealing process prior to the final heat treatment process, a sum of area ratios of β and γ phases is preferably 0% to 1.0% and more preferably 0% to 0.6%.

Alternatively, in the recrystallization heat treatment process, on the condition that all the requirements such as an average grain size and a particle size of a precipitate are satisfied, batch type annealing may be performed under conditions of, for example, a heating temperature range from 330° C. to 440° C. and a holding time of 1 hour to 10 hours.

Further, after the finish cold-rolling process, the recovery heat treatment process may be performed which satisfies a relationship of $30 \leq It \leq 250$ and is a heat treatment in which a maximum reaching temperature is 120° C. to 550° C., and a holding time in a range from "maximum reaching temperature-50° C." to the maximum reaching temperature is 0.02 minute to 6.0 minutes. A spring deflection limit, a strength, and stress relaxation characteristics of a material are improved due to a low-temperature annealing effect which is obtained by the above-described low-temperature or short-period recovery heat treatment where recrystallization does not occur, that is, where almost no phase changes occur in a metallographic structure. In addition, in some cases, a heat treatment for recovering a conductivity decreased by rolling may be performed. In particular, when an alloy contains Ni, stress relaxation characteristics are significantly improved. Regarding It, the lower limit is preferably greater than or equal to 50 and more preferably greater than or equal to 90, and the upper limit is preferably less than or equal to 230 and more preferably less than or equal to 210. By performing a heat treatment that satisfies a conditional expression of $30 \leq It \leq 250$, as compared to before the recovery heat treatment process, a spring deflection limit is improved by approximately 1.5 times, and a conductivity is improved by 0.3% IACS to 1% IACS. The alloys according to the invention are mainly used for components such as a connector, and in many cases, are subjected to Sn plating in a rolled material state or after being molded into a component. In a Sn plating process, a rolled material or a component is heated at a low temperature of 150° C. to 300° C. Even when this Sn plating process is performed after the recovery heat treatment process, there are almost no effects on the properties after the recovery heat treatment process. On the other hand, a heating process during Sn plating can be performed instead of the recovery heat treatment process. In addition, without the recovery heat treatment process, stress relaxation characteristics, spring strength, and bending workability of a rolled material can be improved.

Next, the reason why a sum of area ratios of β and γ phases is 0% to 0.9% will be described.

According to the invention, from the viewpoint of a metallographic structure, as a base, slight amounts of or no β and γ phases remain in an α-phase matrix, that is, a sum of area ratios of β and γ phases is 0% to 0.9%. To this base, Zn, a small amount of Sn, and P having the grain growth suppressing effect are added and, optionally, a small amount of Co or Ni; or Fe is further added to obtain predetermined fine or ultra-fine crystal grains. Due to solid solution strengthening by Zn and Sn and work hardening within a range not impairing ductility and elongation, the alloys according to the invention have a high strength, satisfactory elongation and conductivity, and superior stress relaxation characteristics. When a sum of area ratios of hard and brittle β and γ phases in an α phase matrix is greater than 0.9%, elongation and bending workability deteriorate, and a tensile strength and stress relaxation characteristics also deteriorate. The sum of area ratios of β and γ phases is preferably lower than or equal to 0.6%, more preferably lower than or equal to 0.4%, and most preferably lower than or equal to 0.2%. It is preferable that the sum of area ratios of p and γ phases be 0% or close to 0%. In such area ratio ranges, there are almost no effects on elongation and bending workability. In order to maximize solid solution strengthening, specific strength, and interaction by Sn and Zn, it is most effective that no β and γ phases be present or β and γ phases be present to a degree that does not affect elongation. When the sum of the area ratios are out of the above-described ranges, β and γ phases which are formed in a Cu—Zn—Sn—P alloy containing 28% to 35% of Zn, Sn, and P have harder and more brittle properties than those of β and γ phases of a Cu—Zn alloy not containing Sn and adversely affect ductility and bending workability of the alloy. This is because, roughly, a γ phase is formed from 50 mass % of Cu, 40 mass % of Zn, and 10 mass % of Sn, a β phase is formed from 60 mass % of Cu, 37 mass % of Zn, and 3 mass % of Sn, and the p and γ phase contain a large amount of Sn. Accordingly, it is necessary that the composition be controlled such that 28 mass % to 35 mass % of Zn, 0.15 mass % to 0.75 mass % of Sn, 0.005 mass % to 0.05 mass % of P, and a balance consisting of Cu are contained and such that $44 \geq [Zn]+20[Sn]n \geq 37$ and $32 \leq [Zn]+9([Sn]-0.25)^{1/2} \leq 37$ are satisfied regarding a relationship between Zn and Sn. In these relational expressions, in order to obtain a more preferable metallographic structure, it is more preferable that $[Zn]+9([Sn]-0.25)^{1/2}\leq 36$, and it is most preferable that $[Zn]+9([Sn]-0.25)^{1/2}\leq 35.5$ and $33\leq[Zn]+9([Sn]-0.25)^{1/2}$. In addition, it is preferable that $43\geq[Zn]+20[Sn]$, and it is most preferable that $42\geq[Zn]+20[Sn]$. It is preferable that $[Zn]+20[Sn]n\geq 37.5$, and it is most preferable that $[Zn]+20[Sn]\geq 38$. In the above-described expression, when the Sn content is less than or equal to 0.25 mass %, there is little effect of Sn. Therefore, the item $([Sn]-0.25)^{1/2}$ is considered 0. In addition, in a case where β and γ phases have an area ratio greater than a predetermined value before the final recrystallization heat treatment process, when the final recrystallization heat treatment process is performed under grain refinement conditions of 330° C. to 380° C. and 3 hours to 8 hours, only small amounts of β and γ phases are decreased. During operation and production after the casting and hot-rolling processes, in order to efficiently decrease β and γ phases which are present in the non-equilibrium state, the following requirements should be satisfied. In the case of short-period annealing, a numerical value of It during an intermediate annealing process is preferably set to be high at 440 to 580. In addition, in the case of batch type annealing, an annealing temperature is set to be 420° C. to 560° C., a numerical value of It is set to be 380 to 540, a sum of area ratios of β and γ phases is decreased to 0% to 1.0%, and a grain size is set to be 3 μm to 12 μm so as not to be greater than a predetermined grain size. In the final recrystallization annealing process, short-period but high-temperature recrystallization annealing is effective. In this temperature range (480° C. to 690° C.), both β and γ phases are out of stable ranges and can be decreased.

In the example according to the embodiments of the invention, the manufacturing process includes the hot-rolling process, the first cold-rolling process, the annealing process, the second cold-rolling process, the recrystallization heat treatment process, and the finish cold-rolling process in this order. However, the processes until the recrystallization heat treatment process are not necessarily performed. In a metallographic structure of a copper alloy material before the finish cold-rolling process, it is preferable that an average grain size be 2.0 μm to 7.0 μm and a sum of an area ratio of a β phase and an area ratio of a γ phase be 0% to 0.9%. For example, a copper alloy material having such a metallographic structure may be obtained by processes such as hot extrusion, forging, and a heat treatment.

EXAMPLES

Using the above-described first, second, third, and fourth alloys according to the invention and alloys having a composition for comparison, samples were manufactured while changing a manufacturing process.

Table 1 shows the compositions of the first, second, third, and fourth alloys according to the invention and the comparative alloys which were manufactured as the samples. In this table, when the Co content is less than or equal to 0.001 mass %, the Ni content is less than or equal to 0.01 mass %, or the Fe content is less than or equal to 0.005 mass %, a cell for each element is left blank.

TABLE 1

| | Alloy | Alloy Composition (mass %) | | | | | | | | | | | |
|---|---|---|---|---|---|---|---|---|---|---|---|---|---|
| | No. | Cu | Zn | Sn | P | Co | Ni | Fe | Others | f1 | f2 | [Co]/[P] | [Ni]/[P] |
| First Alloy | 1 | Rem. | 31.62 | 0.43 | 0.02 | | | | | 40.2 | 35.4 | 0.0 | 0.0 |
| According to | 2 | Rem. | 33.11 | 0.33 | 0.02 | | | | | 39.7 | 35.7 | 0.0 | 0.0 |
| Invention | 3 | Rem. | 30.10 | 0.60 | 0.03 | | | | | 42.1 | 35.4 | 0.0 | 0.0 |
| | 4 | Rem. | 30.54 | 0.47 | 0.02 | | | | | 39.9 | 34.8 | 0.0 | 0.0 |
| Second Alloy | 5 | Rem. | 30.02 | 0.55 | 0.02 | 0.02 | | | | 41.0 | 34.9 | 1.0 | 0.0 |
| According to | 6 | Rem. | 31.33 | 0.46 | 0.03 | 0.02 | | | | 40.5 | 35.5 | 0.7 | 0.0 |
| Invention | 7 | Rem. | 32.64 | 0.33 | 0.02 | 0.009 | | | | 39.2 | 35.2 | 0.5 | 0.0 |
| | 8 | Rem. | 31.13 | 0.40 | 0.04 | 0.03 | | | | 39.1 | 34.6 | 0.8 | 0.0 |
| | 9 | Rem. | 31.75 | 0.44 | 0.04 | | 1.29 | | | 40.6 | 35.7 | 0.0 | 32.3 |
| | 10A | Rem. | 29.03 | 0.65 | 0.02 | | 0.66 | | | 42.0 | 34.7 | 0.0 | 33.0 |
| | 10B | Rem. | 29.80 | 0.56 | 0.03 | 0.01 | 0.75 | | | 41.0 | 34.8 | 0.3 | 25.0 |
| First Alloy | 11 | Rem. | 29.82 | 0.37 | 0.02 | | | | | 37.2 | 32.9 | 0.0 | 0.0 |
| According to | 12 | Rem. | 33.90 | 0.26 | 0.02 | | | | | 39.1 | 34.8 | 0.0 | 0.0 |
| Invention | 13 | Rem. | 32.02 | 0.36 | 0.009 | | | | | 39.2 | 35.0 | 0.0 | 0.0 |
| Second Alloy | 14 | Rem. | 31.34 | 0.36 | 0.03 | 0.02 | | | | 38.5 | 34.3 | 0.7 | 0.0 |
| According to | 14A | Rem. | 31.42 | 0.36 | 0.03 | 0.04 | | | | 38.6 | 34.4 | 1.3 | 0.0 |
| Invention | 15 | Rem. | 34.05 | 0.26 | 0.02 | 0.02 | | | | 39.3 | 35.0 | 1.0 | 0.0 |
| | 16 | Rem. | 31.16 | 0.46 | 0.014 | 0.008 | | | | 40.4 | 35.3 | 0.6 | 0.0 |
| | 17 | Rem. | 29.05 | 0.42 | 0.03 | | 0.74 | | | 37.5 | 32.8 | 0.0 | 24.7 |
| | 18 | Rem. | 34.10 | 0.33 | 0.04 | 0.02 | 0.98 | | | 40.7 | 36.6 | 0.5 | 24.5 |
| | 19 | Rem. | 31.50 | 0.55 | 0.04 | 0.01 | 1.33 | | | 42.5 | 36.4 | 0.3 | 33.3 |
| Third Alloy | 20 | Rem. | 31.13 | 0.38 | 0.03 | | | 0.02 | | 38.7 | 34.4 | 0.0 | 0.0 |
| According to Invention | | | | | | | | | | | | | |
| Fourth Alloy | 20A | Rem. | 30.42 | 0.51 | 0.03 | | 0.77 | 0.013 | | 40.6 | 35.0 | 0.0 | 25.7 |
| According to | 20B | Rem. | 31.30 | 0.45 | 0.03 | 0.02 | | 0.01 | | 40.3 | 35.3 | 0.7 | 0.0 |
| Invention | | | | | | | | | | | | | |
| Comparative | 21 | Rem. | 32.50 | 0.35 | 0.08 | | | | | 39.5 | 35.3 | 0.0 | 0.0 |
| Alloy | 22 | Rem. | 30.58 | 0.43 | 0.003 | | | | | 39.2 | 34.4 | 0.0 | 0.0 |
| | 23 | Rem. | 31.20 | 0.40 | 0.002 | 0.01 | | | | 39.2 | 34.7 | 5.0 | 0.0 |
| | 24 | Rem. | 32.35 | 0.36 | 0.09 | 0.02 | | | | 39.6 | 35.3 | 0.2 | 0.0 |
| | 25 | Rem. | 31.43 | 0.45 | 0.03 | 0.09 | | | | 40.4 | 35.5 | 3.0 | 0.0 |
| | 26 | Rem. | 35.80 | 0.25 | 0.03 | | | | | 40.8 | 35.8 | 0.0 | 0.0 |
| | 27 | Rem. | 27.70 | 0.50 | 0.02 | | | | | 37.7 | 32.2 | 0.0 | 0.0 |
| | 28 | Rem. | 29.30 | 0.79 | 0.02 | | | | | 45.1 | 35.9 | 0.0 | 0.0 |
| | 29 | Rem. | 32.34 | 0.54 | 0.03 | | | | | 43.1 | 37.2 | 0.0 | 0.0 |
| | 30 | Rem. | 31.03 | 0.26 | 0.02 | | | | | 36.2 | 31.9 | 0.0 | 0.0 |
| | 31 | Rem. | 30.64 | 0.27 | 0.02 | 0.01 | | | | 36.0 | 31.9 | 0.5 | 0.0 |
| | 32 | Rem. | 33.76 | 0.39 | 0.02 | 0.02 | | | | 41.6 | 37.1 | 1.0 | 0.0 |

TABLE 1-continued

| | Alloy No. | Alloy Composition (mass %) Cu | Zn | Sn | P | Co | Ni | Fe | Others | f1 | f2 | [Co]/[P] | [Ni]/[P] |
|---|---|---|---|---|---|---|---|---|---|---|---|---|---|
| | 33 | Rem. | 34.50 | 0.36 | 0.03 | | 0.63 | | | 41.7 | 37.5 | 0.0 | 21.0 |
| | 34 | Rem. | 31.50 | 0.69 | 0.03 | | 0.61 | | | 45.3 | 37.5 | 0.0 | 20.3 |
| Second Alloy | 35 | Rem. | 30.70 | 0.45 | 0.05 | 0.02 | 0.65 | | | 39.7 | 34.7 | 0.4 | 13.0 |
| According to Invention | 36 | Rem. | 30.55 | 0.42 | 0.01 | | 0.88 | | | 39.0 | 34.3 | 0.0 | 88.0 |
| Comparative Alloy | 37 | Rem. | 30.75 | 0.38 | 0.01 | | 0.41 | | | 38.4 | 34.0 | 0.0 | 41.0 |
| Fourth Alloy According to Invention | 38 | Rem. | 30.85 | 0.44 | 0.03 | 0.03 | | 0.02 | | 39.7 | 34.8 | 1.0 | 0.0 |
| Comparative | 39 | Rem. | 30.55 | 0.46 | 0.02 | | | 0.04 | | 39.8 | 34.7 | 0.0 | 0.0 |
| Alloy | 40 | Rem. | 31.10 | 0.41 | 0.02 | | | | Cr: 0.04 | 39.3 | 34.7 | 0.0 | 0.0 |
| | 41 | Rem. | 34.60 | 0.13 | 0.01 | | | | | 37.2 | | 0.0 | 0.0 |
| | 42 | Rem. | 27.65 | 0.53 | 0.01 | | 0.66 | | | 38.3 | 32.4 | 0.0 | 66.0 |

$f1 = [Zn] + 20[Sn]$, $f2 = [Zn] + 9([Sn] - 0.25)^{1/2}$

The comparative alloys are out of the composition range of the alloys according to the invention from the following viewpoints.

In Alloy No. 21, the P content is greater than that of the composition range of the alloys according to the invention.

In Alloy No. 22, the P content is less than that of the composition range of the alloys according to the invention.

In Alloy No. 23, the P content is less than that of the composition range of the alloys according to the invention.

In Alloy No. 24, the P content is greater than that of the composition range of the alloys according to the invention.

In Alloy No. 25, the Co content is greater than that of the composition range of the alloys according to the invention.

In Alloy No. 26, the Zn content is greater than that of the composition range of the alloys according to the invention.

In Alloy No. 27, the Zn content is less than that of the composition range of the alloys according to the invention.

In Alloy No. 28, the Sn content and the index f1 are greater than those of the composition range of the alloys according to the invention.

In Alloy No. 29, the index f2 is greater than that of the composition range of the alloys according to the invention.

In Alloy No. 30, the index f1 is less than that of the composition range of the alloys according to the invention.

In Alloy No. 31, the index f1 is less than that of the composition range of the alloys according to the invention.

In Alloy No. 32, the index f2 is greater than that of the composition range of the alloys according to the invention.

In Alloy No. 33, the index f2 is greater than that of the composition range of the alloys according to the invention.

In Alloy No. 34, the index f1 and the index f2 are greater than those of the composition range of the alloys according to the invention.

In Alloy No. 37, the Ni content is less than that of the composition range of the alloys according to the invention.

In Alloy No. 39, the Fe content is greater than that of the composition range of the alloys according to the invention.

To Alloy No. 40, Cr is added.

In Alloy No. 41, the Sn content is less than that of the composition range of the alloys according to the invention.

In Alloy No. 42, the Zn content is less than that of the composition range of the alloys according to the invention.

The samples were manufactured by three kinds of manufacturing processes A, B, and C. In each manufacturing process, manufacturing conditions were further changed. The manufacturing process A was performed in an actual mass-production facility, and the manufacturing processes B and C were performed in an experimental facility. Table 2 shows manufacturing conditions of each manufacturing process.

TABLE 2

| Process No. | | Hot-Rolling Process Start Temperature, Thickness | Cooling Process Cooling Rate | Milling Process Thickness | First Cold-Rolling Process Thickness (mm) | First Cold-Rolling Process Red (%)*1 | Annealing Process Heat Treatment Conditions | It |
|---|---|---|---|---|---|---|---|---|
| A1 | Ex. | 830° C., 12 mm | 5° C./s | 11 mm | 1.5 | 86.4 | 480° C. × 4 Hr | 459 |
| A2 | Ex. | 830° C., 12 mm | 5° C./s | 11 mm | 1.5 | 86.4 | 480° C. × 4 Hr | 459 |
| A3 | Ex. | 830° C., 12 mm | 5° C./s | 11 mm | 1.5 | 86.4 | 480° C. × 4 Hr | 459 |
| A4 | Comp. Ex. | 830° C., 12 mm | 5° C./s | 11 mm | 1.5 | 86.4 | 480° C. × 4 Hr | 459 |
| A41 | Comp. Ex. | 830° C., 12 mm | 5° C./s | 11 mm | 1.5 | 86.4 | 480° C. × 4 Hr | 459 |
| A5 | Comp. Ex. | 830° C., 12 mm | 5° C./s | 11 mm | 1.5 | 86.4 | 480° C. × 4 Hr | 459 |
| A6 | Ex. | 830° C., 12 mm | 5° C./s | 11 mm | 1.5 | 86.4 | 480° C. × 4 Hr | 459 |
| B0*2 | Ex. | 830° C., 8 mm | 0.3° C./s | Pickling | 1.5 | 81.3 | 480° C. × 4 Hr | 456 |

TABLE 2-continued

| | | | | | | | | |
|---|---|---|---|---|---|---|---|---|
| B1 | Ex. | 830° C., 8 mm | 5° C./s | Pickling | 1.5 | 81.3 | 480° C. × 4 Hr | 456 |
| B21 | Comp. Ex. | 830° C., 8 mm | 0.3° C./s | Pickling | 1.5 | 81.3 | 480° C. × 4 Hr | 456 |
| B31 | Ex. | 830° C., 8 mm | 5° C./s | Pickling | 1.2 | 85 | 480° C. × 4 Hr | 458 |
| B32 | Comp. Ex. | 830° C., 8 mm | 5° C./s | Pickling | 0.65 | 91.9 | 480° C. × 4 Hr | 463 |
| B41 | Ex. | 830° C., 8 mm | 5° C./s | Pickling | 1.5 | 81.3 | 520° C. × 4 Hr | 496 |
| B42 | Comp. Ex. | 830° C., 8 mm | 5° C./s | Pickling | 1.5 | 81.3 | 570° C. × 4 Hr | 546 |
| B43 | Ex. | 830° C., 8 mm | 5° C./s | Pickling | 1.5 | 81.3 | 580° C. × 0.2 min | 469 |
| B44 | Ex. | 830° C., 8 mm | 5° C./s | Pickling | 1.5 | 81.3 | 560° C. × 0.4 min | 475 |
| B45 | Comp. Ex. | 830° C., 8 mm | 5° C./s | Pickling | 1.5 | 81.3 | 480° C. × 0.2 min | 369 |
| B46 | Comp. Ex. | 830° C., 8 mm | 5° C./s | Pickling | 1.5 | 81.3 | 390° C. × 4 Hr | 366 |
| C2 | Ex. | 830° C., 8 mm | 5° C./s | Pickling | 1.5 | 81.3 | 480° C. × 4 Hr | 456 |
| C1 | Ex. | 830° C., 8 mm | 5° C./s | Pickling | 1.5 | 81.3 | 480° C. × 4 Hr | 456 |

| | Second Cold-Rolling Process | | Recrystallization Heat Treatment Process | | Finish Cold-Rolling Process | | Recovery Heat Treatment Process | |
|---|---|---|---|---|---|---|---|---|
| Process No. | Thickness (mm) | Red (%) | Heat Treatment Conditions | It | Thickness (mm) | Red (%) | Heat Treatment Conditions | It |
| A1 | 0.375 | 75 | 625° C. × 0.07 min | 449 | 0.3 | 20 | | |
| A2 | 0.375 | 75 | 590° C. × 0.07 min | 414 | 0.3 | 20 | | |
| A3 | 0.375 | 75 | 660° C. × 0.08 min | 494 | 0.3 | 20 | | |
| A4 | 0.375 | 75 | 535° C. × 0.07 min | 359 | 0.3 | 20 | | |
| A41 | 0.375 | 75 | 535° C. × 0.07 min | 359 | 0.3 | 16.7 | | |
| A5 | 0.375 | 75 | 695° C. × 0.08 min | 529 | 0.3 | 20 | | |
| A6 | 0.375 | 75 | 625° C. × 0.07 min | 449 | 0.3 | 20 | 460° C. × 0.03 min | 184 |
| B0*2 | 0.375 | 75 | 625° C. × 0.07 min | 449 | 0.3 | 20 | | |
| B1 | 0.375 | 75 | 625° C. × 0.07 min | 449 | 0.3 | 20 | | |
| B21 | 0.375 | 75 | 625° C. × 0.07 min | 449 | 0.3 | 20 | | |
| B31 | 0.375 | 68.8 | 625° C. × 0.07 min | 466 | 0.3 | 20 | | |
| B32 | 0.375 | 4.23 | 625° C. × 0.07 min | 436 | 0.3 | 20 | | |
| B41 | 0.375 | 75 | 625° C. × 0.07 min | 449 | 0.3 | 20 | | |
| B42 | 0.375 | 75 | 625° C. × 0.07 min | 449 | 0.3 | 20 | | |
| B43 | 0.375 | 75 | 625° C. × 0.07 min | 449 | 0.3 | 20 | | |
| B44 | 0.375 | 75 | 625° C. × 0.07 min | 449 | 0.3 | 20 | 240° C. × 0.2 min | 106 |
| B45 | 0.375 | 75 | 625° C. × 0.07 min | 449 | 0.3 | 20 | | |
| B46 | 0.375 | 75 | 625° C. × 0.07 min | 449 | 0.3 | 20 | | |
| C2 | 0.375 | 75 | 625° C. × 0.07 min | 449 | 0.3 | 20 | 265° C. × 0.1 min | 94 |
| C1 | 0.375 | 75 | 625° C. × 0.07 min | 449 | 0.3 | 20 | | |

*1 Red of the first cold-rolling process was calculated without considering a decrease in thickness caused by pickling.

*2 In the process B0, after hot-rolling, cooling was performed to 350° C. or lower at a cooling rate of 0.3° C./sec, followed by a heat treatment at a temperature of 550° C. for 4 hours.

In the manufacturing process A (A1, A2, A3, A4, A41, A5, and A6), raw materials were melted in a medium frequency melting furnace having a capacity of 10 tons. An ingot with a cross-section having a thickness of 190 mm and a width of 630 mm was manufactured by semi-continuous casting. The ingot was cut into a length of 1.5 m. Next, a hot-rolling process (thickness: 12 mm), a cooling process, a milling process (thickness: 11 mm), a first cold-rolling process (thickness: 1.5 mm), an annealing process (480° C., holding time: 4 hours), a second cold-rolling process (thickness: 0.375 mm, cold-rolling ratio: 75%; partially, thickness: 0.36 mm, cold-rolling ratio: 76%), a recrystallization heat treatment process, a finish cold-rolling process (thickness: 0.3 mm, cold-rolling ratio: 20%; partially, cold-rolling ratio: 16.7%), and a recovery heat treatment process were performed.

A hot-rolling start temperature in the hot-rolling process was set as 830° C. After hot-rolling to a thickness of 12 mm, the ingot was cooled with a water shower in the cooling process. In this specification, the hot-rolling start temperature has the same definition as that of an ingot heating temperature. An average cooling rate in the cooling process was defined as a cooling rate in a temperature range of a rolled material from 480° C. to 350° C. after final hot-rolling and was measured at a back end of a rolled sheet. The measured average cooling rate was 5° C./sec.

In the cooling process, shower cooling was performed as follows. A shower facility was provided at a position that was provided above a carrying roller for carrying a rolled material during hot-rolling and distant from a hot-rolling roller. After completion of a final pass of hot-rolling, a rolled material was carried to the shower facility by the carrying roller and was cooled sequentially from a front end to a back end thereof while passing through a position where shower cooling was performing. The cooling rate was measured as follows. A position of a rolled material for measuring a temperature is a back end portion (to be exact, a 90% position of the length of a rolled material from a rolling front end in a longitudinal direction of the rolled material) of a rolled material in a final pass of hot-rolling. The temperature was measured immediately before a rolled material was carried to the shower facility after completion of the final pass and was measured at the time of completion of shower cooling. Based on the measured temperatures and the measurement time interval at this time, a cooling rate was measured. The temperature was measured using a radiation thermometer. As the radiation thermometer, an infrared thermometer Fluke-574 (manufactured by Takachihoseiki Co., Ltd.) was used. Therefore, a rolled material is air-cooled until a back end of the rolled material reaches the shower facility and the water shower is applied to the rolled material, and a cooling rate at this time is low. In addition, as the final thickness is smaller, a time required for a rolled material to reach the shower facility is longer, which decreases a cooling rate.

In the annealing process, a rolled material was annealed in a batch type annealing furnace under conditions of a heating temperature of 480° C. and a holding time of 4 hours.

In the recrystallization annealing process, a maximum reaching temperature Tmax (° C.) of a rolled material and a holding time tm (min) in a temperature range from a temperature, which was 50° C. lower than the maximum reaching temperature of the rolled material, to the maximum reaching temperature were changed as follows: the manufacturing process A1 (625° C., 0.07 min); the manufacturing process A2 (590° C., 0.07 min); the manufacturing process A3 (660° C., 0.08 min); the manufacturing processes A4 and A41 (535° C., 0.07 min); and the manufacturing process A5 (695° C., 0.08 min).

In the manufacturing process A41, a cold-rolling ratio in the finish cold-rolling process was 16.7%.

In addition, in the manufacturing process A6, the recovery heat treatment process was performed after the finish cold-rolling process. As for the conditions, a maximum reaching temperature Tmax (° C.) of a rolled material was set as 460 (° C.), and a holding time tm (min) in a temperature range from a temperature, which was 50° C. lower than the maximum reaching temperature of the rolled material, to the maximum reaching temperature was set as 0.03 minutes.

In addition, the manufacturing process B (B0, B1, B21, B31, B32, B41, B42, B43, B44, B45 and B46) were performed as follows.

An ingot for a laboratory test having a thickness of 40 mm, a width of 120 mm, and a length of 190 mm was cut from the ingot of the manufacturing process A. Next, a hot-rolling process (thickness: 8 mm), a cooling process (shower cooling), a pickling process, a first cold-rolling process, an annealing process, a second cold-rolling process (thickness: 0.375 mm), a recrystallization heat treatment process, and a finish cold-rolling process (thickness: 0.3 mm, rolling ratio: 20%) were performed.

In the hot-rolling process, the ingot was heated to 830° C. and was hot-rolled to a thickness of 8 mm. A cooling rate (a cooling rate in a temperature range of a rolled material from 480° C. to 350° C.) in the cooling process was 5° C./sec. In the manufacturing processes B0 and B21, the cooling rate was 0.3° C./sec.

In the manufacturing process B0, after cooling, a heat treatment of holding a rolled material at a maximum reaching temperature of 550° C. for 4 hours was further performed.

After the cooling process, a surface of the resultant material was pickled. In the first cold-rolling process, the resultant material was cold-rolled to 1.5 mm, 1.2 mm (manufacturing process B31), or 0.65 mm (manufacturing process B32). In the annealing process, conditions are changed as follows: the manufacturing process B43 (580° C., holding time: 0.2 minutes); the manufacturing processes B0, B1, B21, B31, and B32 (480° C., holding time: 4 hours); the manufacturing process B41 (520° C., holding time: 4 hours); the manufacturing process B42 (570° C., holding time: 4 hours); the manufacturing process B44 (560° C., holding time: 0.4 minutes); the manufacturing process B45 (480° C., holding time: 0.2 minutes); and the manufacturing process B46 (390° C., holding time: 4 hours). Next, in the second cold-rolling process, the resultant material was rolled to 0.375 mm.

In the recrystallization heat treatment, conditions were a maximum reaching temperature Tmax of 625 (° C.) and a holding time tm of 0.07 minutes. In the finish cold-rolling process, the resultant material was cold-rolled (cold-rolling ratio: 20%) to 0.3 mm. In addition, in the manufacturing process B44, the recovery heat treatment process was performed after the finish cold-rolling process. As conditions, a maximum reaching temperature Tmax (° C.) of a rolled material was set as 240 (° C.), and a holding time tm (min) in a temperature range from a temperature, which was 50° C. lower than the maximum reaching temperature of the rolled material, to the maximum reaching temperature was set as 0.2 minutes. In an actual operation, these conditions correspond to Sn plating conditions.

In the manufacturing process B and the manufacturing process C described below, a process of dipping a rolled material in a salt bath was performed instead of the process of the manufacturing process A corresponding to a short-period heat treatment performed by a continuous annealing line or the like. In this process, a maximum reaching temperature was set as a liquid temperature of the salt bath, a dipping time was set as a holding time, and air-cooling was performed after dipping. As a salt (solution), a mixture of BaCl, KCl, and NaCl was used.

Moreover, as an actual laboratory test, the manufacturing process C (C1 and C2) was performed as follows. Raw materials were melted in a laboratory electric furnace and cast so as to obtain a predetermined composition. As a result, an ingot for a laboratory test having a thickness of 40 mm, a width of 120 mm, and a length of 190 mm was obtained. Next, the same processes as those of the above-described manufacturing process B1 were performed. That is, the ingot was heated to 830° C. and was hot-rolled to a thickness of 8 mm. After hot-rolling, a rolled material was cooled at a cooling rate of 5° C./sec in a temperature range of the rolled material from 480° C. to 350° C. After cooling, a surface of the resultant material was pickled. In the first cold-rolling process, the resultant material was cold-rolled to 1.5 mm. After cold-rolling, the annealing process was performed under conditions of 480° C. and 4 hours. In the second cold-rolling process, the resultant material was cold-rolled to 0.375 mm. In the recrystallization heat treatment process, conditions were a maximum reaching temperature Tmax of 625 (° C.) and a holding time tm of 0.07 minutes. In the finish cold-rolling process, the resultant material was cold-rolled (cold-rolling ratio: 20%) to 0.3 mm. In addition, in the manufacturing process C2, the recovery heat treatment process was performed after the finish cold-rolling process. As for the conditions, a maximum reaching temperature Tmax (° C.) of a rolled material was set as 265 (° C.), and a holding time tm (min) in a temperature range from a temperature, which was 50° C. lower than the maximum reaching temperature of the rolled material, to the maximum reaching temperature was set as 0.1 minutes.

For evaluation of the copper alloys which were manufactured using the above-described methods, a tensile strength, a proof strength, elongation, conductivity, bending workability, and a spring deflection limit were measured. In addition, by observing a metallographic structure, an average grain size and area ratios of β and γ phases were measured.

The results of each test described above are shown in Tables 3 to 9. In the manufacturing process A6, since the recovery heat treatment process was performed, data after the recovery heat treatment process is described in the item "Properties after Finish Cold-Rolling".

TABLE 3

| Test No. | Alloy No. | Process No. | Average Particle Size of Precipitate After Recrystallization Heat Treatment Process nm | Density g/cm³ | Average Grain Size After Finish Cold-Rolling μm | Average Grain Size After Annealing Process μm | Average Grain Size After Hot-Rolling μm | Area Ratio of β Phase + γ Phase After Finish Cold-Rolling % | Area Ratio of β Phase + γ Phase After Annealing Process % | Area Ratio of β Phase + γ Phase After Hot-Rolling % |
|---|---|---|---|---|---|---|---|---|---|---|
| 1 | 1 | A1 | | 8.48 | 4.0 | 4.5 | 20 | 0.4 | 1.0 | 2.4 |
| 2 | | A2 | | 8.48 | 3.1 | 4.5 | 20 | 0.6 | 1.0 | 2.4 |
| 3 | | A4 | | 8.48 | 1.9 | 4.5 | 20 | 0.9 | 1.0 | 2.3 |
| 4 | | A41 | | 8.48 | 1.9 | 4.5 | 20 | 0.9 | 1.0 | 2.3 |
| 5 | | A3 | | 8.48 | 5.5 | 4.5 | 20 | 0.2 | 1.0 | 2.4 |
| 6 | | A5 | | 8.48 | 14.0 | 4.5 | 20 | 0.4 | 1.0 | 2.4 |
| 7 | | A6 | | 8.49 | 4.0 | 4.5 | 20 | 0.3 | 1.0 | 2.4 |
| 8 | | B0 | | 8.48 | 4.2 | 6.5 | 35 | 0.1 | 0.3 | 0.8 |
| 9 | | B1 | | 8.48 | 4.0 | 4.7 | 23 | 0.3 | 1.1 | 2.5 |
| 10 | | B21 | | 8.48 | 3.7 | 4.7 | 25 | 1.0 | 1.4 | 2.1 |
| 11 | | B31 | | 8.48 | 4.0 | 4.7 | 23 | 0.5 | 1.0 | 2.5 |
| 12 | | B32 | | 8.48 | 4.3, Mixed Grain Size | 4.5 | 23 | 0.6 | 1.0 | 2.5 |
| 13 | | B41 | | 8.48 | 4.3 | 7.5 | 23 | 0.1 | 0.5 | 2.5 |
| 14 | | B42 | | 8.48 | 5, Mixed Grain Size | 20.0 | 23 | 0.0 | 0.3 | 2.5 |
| 15 | | B43 | | 8.48 | 3.8 | 5.0 | 23 | 0.2 | 0.7 | 2.5 |
| N1 | | B44 | | 8.48 | 4.2 | 5.0 | 23 | 0.2 | 0.6 | 2.5 |
| N2 | | B45 | | 8.48 | 2.0 | 2.5 | 23 | 1.4 | 1.9 | 2.5 |
| N3 | | B46 | | 8.48 | 2.0 | 2.5 | 23 | 1.3 | 1.8 | 2.5 |
| 16 | 2 | A1 | | 8.46 | 4.0 | 4.8 | 20 | 0.6 | 1.2 | 3.4 |
| 17 | | A2 | | 8.46 | 3.6 | 4.8 | 20 | 0.8 | 1.2 | 3.4 |
| 18 | | A4 | | 8.46 | 2.3 | 4.8 | 20 | 1.1 | 1.2 | 3.4 |
| 19 | | A41 | | 8.46 | 2.3 | 4.8 | 20 | 1.1 | 1.2 | 3.4 |
| 20 | | A3 | | 8.46 | 6.0 | 4.8 | 20 | 0.5 | 1.2 | 3.4 |
| 21 | | A5 | | 8.46 | 12.0 | 4.8 | 20 | 0.6 | 1.2 | 3.4 |
| 22 | | A6 | | 8.48 | 4.0 | 4.8 | 20 | 0.6 | 1.2 | 3.4 |
| N4 | | B41 | | 8.48 | 5.0 | 8.0 | 23 | 0.2 | 0.6 | 3.4 |
| N5 | | B46 | | 8.48 | 2.0 | 2.7 | 23 | 1.8 | 2.4 | 3.4 |
| 23 | 3 | A1 | | 8.50 | 3.3 | 4.4 | 20 | 0.4 | 0.8 | 2.1 |
| 24 | | A2 | | 8.50 | 2.9 | 4.4 | 20 | 0.6 | 0.8 | 2.1 |
| 25 | | A4 | | 8.50 | 1.9 | 4.4 | 20 | 0.8 | 0.8 | 2.1 |

| | Properties After Finish Cold-Rolling | | | | | | | | |
|---|---|---|---|---|---|---|---|---|---|
| | | | | | | Bending Workability | | | |
| Test No. | Tensile Strength N/mm² | Proof Strength N/mm² | Elongation % | Conductivity % IACS | Balance Index fe | 90° Direction Bad Way | 0° Direction Good Way | Stress Relaxation Rate % | Spring Deflection Limit N/mm² |
| 1 | 591 | 547 | 8 | 24.1 | 370 | A | A | 62 | 380 |
| 2 | 608 | 570 | 6 | 24.1 | 373 | B | A | 68 | 420 |

TABLE 3-continued

| | | | | | | | | | |
|---|---|---|---|---|---|---|---|---|---|
| 3 | 624 | 583 | 4 | 24.2 | 376 | C | B | 69 | 427 |
| 4 | 597 | 556 | 8 | 24.3 | 375 | C | A | | 377 |
| 5 | 569 | 532 | 9 | 24.1 | 359 | A | A | | 350 |
| 6 | 520 | 486 | 9 | 24.1 | 328 | A | A | | 265 |
| 7 | 607 | 576 | 5 | 24.8 | 374 | A | A | 51 | 540 |
| 8 | 570 | 531 | 9 | 24.2 | 360 | A | A | | 344 |
| 9 | 588 | 546 | 9 | 24.1 | 371 | A | A | 64 | 377 |
| 10 | 583 | 547 | 5 | 24.3 | 356 | C | B | | 330 |
| 11 | 575 | 534 | 7 | 24.0 | 355 | A | A | | 370 |
| 12 | 569 | 530 | 6 | 24.1 | 349 | B | A | | 356 |
| 13 | 566 | 524 | 8 | 24.0 | 353 | A | A | 61 | 365 |
| 14 | 551 | 503 | 5 | 24.1 | 335 | B | A | | 344 |
| 15 | 583 | 546 | 9 | 24.2 | 369 | A | A | | 378 |
| N1 | 591 | 552 | 7 | 24.4 | 368 | A | A | 50 | 530 |
| N2 | 602 | 563 | 4 | 24.1 | 362 | C | B | 69 | 413 |
| N3 | 601 | 559 | 5 | 24.2 | 366 | C | B | | 410 |
| 16 | 584 | 545 | 8 | 23.9 | 364 | A | A | 66 | |
| 17 | 591 | 556 | 7 | 23.9 | 365 | B | B | | |
| 18 | 614 | 573 | 3 | 24.0 | 366 | C | C | | |
| 19 | 588 | 549 | 6 | 24.1 | 362 | C | A | | |
| 20 | 545 | 513 | 8 | 24.0 | 341 | A | A | | |
| 21 | 514 | 478 | 9 | 23.9 | 324 | A | A | | |
| 22 | 598 | 567 | 5 | 24.4 | 366 | B | A | 53 | |
| N4 | 566 | 524 | 9 | 24.0 | 356 | A | A | 63 | |
| N5 | 611 | 562 | 3 | 24.2 | 365 | C | C | | |
| 23 | 597 | 556 | 8 | 23.1 | 365 | A | A | 63 | 411 |
| 24 | 610 | 573 | 7 | 23.1 | 369 | B | A | 66 | 432 |
| 25 | 630 | 583 | 4 | 23.1 | 370 | C | B | | 448 |

TABLE 4

| | | | Average Particle Size of | | Average Grain Size | | | Area Ratio of β Phase + γ Phase | | |
|---|---|---|---|---|---|---|---|---|---|---|
| Test No. | Alloy No. | Process No. | Precipitate After Recrystallization Heat Treatment Process nm | Density g/cm$^3$ | After Finish Cold-Rolling μm | After Annealing Process μm | After Hot-Rolling μm | After Finish Cold-Rolling % | After Annealing Process % | After Hot-Rolling % |
| 26 | 3 | A41 | | 8.51 | 1.9 | 4.4 | 20 | 0.8 | 0.8 | 2.1 |
| 27 | | A3 | | 8.50 | 5.2 | 4.4 | 20 | 0.3 | 0.8 | 2.1 |
| 28 | | A5 | | 8.50 | 12.0 | 4.4 | 20 | 0.3 | 0.8 | 2.1 |
| 29 | | A6 | | 8.52 | 3.3 | 4.4 | 20 | 0.3 | 0.8 | 2.1 |
| 30 | | B0 | | 8.50 | 4.2 | 6.0 | 35 | 0.1 | 0.2 | 0.7 |
| 31 | | B1 | | 8.50 | 3.5 | 4.5 | 23 | 0.4 | 0.8 | 2.2 |
| 32 | | B21 | | 8.49 | 3.8 | 4.5 | 23 | 0.7 | 1.1 | 1.8 |
| 33 | | B31 | | 8.50 | 3.8 | 4.5 | 23 | 0.3 | 0.7 | 2.0 |
| 34 | | B32 | | 8.50 | 4.2, Mixed Grain Size | 4.3 | 23 | 0.4 | 0.7 | 2.2 |
| 35 | | B41 | | 8.51 | 4.0 | 6.5 | 23 | 0.0 | 0.3 | 2.2 |
| 36 | | B42 | | 8.50 | 4.3, Mixed Grain Size | 18.0 | 23 | 0.0 | 0.2 | 2.2 |
| 37 | | B43 | | 8.50 | 3.5 | 5.0 | 23 | 0.2 | 0.6 | 2.2 |
| N6 | | B44 | | 8.50 | 3.8 | 5.0 | 23 | 0.2 | 0.6 | 2.2 |
| N7 | | B45 | | 8.51 | 2.2 | 2.5 | 23 | 1.2 | 1.6 | 2.2 |
| N8 | | B46 | | 8.51 | 2.0 | 2.5 | 23 | 1.1 | 1.5 | 2.2 |
| 38 | 4 | A1 | | 8.52 | 4.2 | 4.5 | 23 | 0.0 | 0.4 | 0.7 |
| 39 | | A2 | | 8.52 | 3.1 | 4.5 | 23 | 0.1 | 0.4 | 0.7 |
| 40 | | A4 | | 8.52 | 2.3 | 4.5 | 23 | 0.3 | 0.4 | 0.7 |
| 41 | | A41 | | 8.53 | 2.3 | 4.5 | 23 | 0.3 | 0.4 | 0.7 |
| 42 | | A3 | | 8.52 | 6.0 | 4.5 | 23 | 0.0 | 0.4 | 0.7 |
| 43 | | A5 | | 8.52 | 14.0 | 4.5 | 23 | 0.1 | 0.4 | 0.7 |
| 44 | | A6 | | 8.54 | 3.6 | 4.5 | 23 | 0.0 | 0.4 | 0.7 |
| 45 | 5 | A1 | 18.0 | 8.51 | 2.4 | 3.2 | 15 | 0.0 | 0.5 | 1.1 |
| 46 | | A2 | 11.0 | 8.51 | 2.1 | 3.2 | 15 | 0.2 | 0.5 | 1.1 |
| 47 | | A4 | 4.5 | 8.52 | 1.5 | 3.2 | 15 | 0.5 | 0.5 | 1.1 |
| 48 | | A41 | | 8.51 | 1.5 | 3.2 | 15 | 0.5 | 0.5 | 1.1 |
| 49 | | A3 | 32.0 | 8.51 | 3.8 | 3.2 | 15 | 0.0 | 0.5 | 1.1 |
| 50 | | A5 | 55.0 | 8.51 | 8.5 | 3.2 | 15 | 0.2 | 0.5 | 1.1 |

TABLE 4-continued

| | Properties After Finish Cold-Rolling | | | | | | | | |
|---|---|---|---|---|---|---|---|---|---|
| | | | | | | Bending Workability | | | |
| Test No. | Tensile Strength N/mm$^2$ | Proof Strength N/mm$^2$ | Elongation % | Conductivity % IACS | Balance Index fe | 90° Direction Bad Way | 0° Direction Good Way | Stress Relaxation Rate % | Spring Deflection Limit N/mm$^2$ |
| 26 | 604 | 559 | 6 | 23.1 | 362 | C | A | | 390 |
| 27 | 559 | 520 | 9 | 23.1 | 345 | A | A | | 362 |
| 28 | 526 | 478 | 9 | 23.1 | 324 | A | A | | 278 |
| 29 | 608 | 570 | 6 | 23.8 | 369 | B | A | 51 | 556 |
| 30 | 576 | 532 | 10 | 23.4 | 361 | A | A | | |
| 31 | 595 | 555 | 9 | 23.3 | 368 | A | A | | |
| 32 | 586 | 540 | 6 | 23.5 | 355 | C | A | | |
| 33 | 581 | 545 | 7 | 23.3 | 353 | A | A | | |
| 34 | 569 | 523 | 5 | 23.2 | 339 | B | A | | |
| 35 | 577 | 536 | 7 | 23.2 | 349 | A | A | | |
| 36 | 566 | 522 | 5 | 23.3 | 337 | B | B | | |
| 37 | 590 | 555 | 9 | 23.4 | 366 | A | A | | |
| N6 | 591 | 552 | 8 | 23.3 | 362 | A | A | 50 | 535 |
| N7 | 622 | 574 | 4 | 24.1 | 373 | C | B | 67 | 423 |
| N8 | 625 | 577 | 4 | 24.2 | 376 | C | B | | 430 |
| 38 | 587 | 546 | 9 | 23.9 | 367 | A | A | | |
| 39 | 594 | 559 | 8 | 23.9 | 368 | A | A | | |
| 40 | 618 | 576 | 6 | 24.0 | 377 | C | A | | |
| 41 | 592 | 563 | 10 | 24.1 | 375 | B | A | | |
| 42 | 546 | 504 | 9 | 23.9 | 341 | A | A | | |
| 43 | 510 | 472 | 10 | 23.9 | 322 | A | A | | |
| 44 | 599 | 566 | 6 | 24.4 | 367 | A | A | | |
| 45 | 607 | 564 | 7 | 23.5 | 370 | A | A | 56 | 407 |
| 46 | 620 | 580 | 6 | 23.5 | 374 | B | A | 57 | 430 |
| 47 | 639 | 597 | 2 | 23.5 | 371 | C | C | 57 | 446 |
| 48 | 612 | 565 | 5 | 23.7 | 368 | C | A | | 402 |
| 49 | 585 | 541 | 8 | 23.5 | 360 | A | A | 58 | 350 |
| 50 | 534 | 482 | 9 | 23.5 | 332 | A | A | | 277 |

TABLE 5

| | | | | | Average Grain Size | | | Area Ratio of β Phase + γ Phase | | |
|---|---|---|---|---|---|---|---|---|---|---|
| Test No. | Alloy No. | Process No. | Average Particle Size of Precipitate After Recrystallization Heat Treatment Process nm | Density g/cm$^3$ | After Finish Cold-Rolling μm | After Annealing Process μm | After Hot-Rolling μm | After Finish Cold-Rolling % | After Annealing Process % | After Hot-Rolling % |
| 51 | 5 | A6 | | 8.53 | 2.4 | 3.2 | 15 | 0.0 | 0.5 | 1.1 |
| 52 | | B0 | 36.0 | 8.51 | 3.0 | 4.3 | 20 | 0.0 | 0.1 | 0.4 |
| 53 | | B1 | 22.0 | 8.52 | 2.5 | 3.5 | 15 | 0.0 | 0.5 | 1.1 |
| 54 | | B21 | 50.0 | 8.51 | 2.6 | 3.5 | 15 | 0.5 | 0.7 | 1.0 |
| 55 | | B31 | | 8.50 | 2.7 | 3.5 | 15 | 0.2 | 0.4 | 1.2 |
| 56 | | B32 | | 8.51 | 3.3, Mixed Grain Size | 3.2 | 15 | 0.1 | 0.4 | 1.1 |
| 57 | | B41 | 30.0 | 8.51 | 3.0 | 5.0 | 15 | 0.0 | 0.2 | 1.1 |
| 58 | | B42 | 52.0 | 8.51 | 3.5, Mixed Grain Size | 13.5 | 15 | 0.0 | 0.1 | 1.1 |
| 59 | | B43 | 22.0 | 8.52 | 2.6 | 3.6 | 15 | 0.0 | 0.3 | 1.1 |
| N9 | | B44 | | 8.52 | 2.5 | 3.8 | 15 | 0.0 | 0.3 | 1.1 |
| 60 | 6 | A1 | 15.0 | 8.48 | 2.6 | 3.5 | 17 | 0.4 | 0.9 | 2.2 |
| 61 | | A2 | 10.0 | 8.48 | 2.3 | 3.5 | 17 | 0.6 | 0.9 | 2.2 |
| 62 | | A4 | 4.5 | 8.48 | 1.7 | 3.5 | 17 | 0.8 | 0.9 | 2.3 |
| 63 | | A41 | | 8.48 | 1.7 | 3.5 | 17 | 0.8 | 0.9 | 2.3 |
| 64 | | A3 | 30.0 | 8.48 | 3.5 | 3.5 | 17 | 0.1 | 0.9 | 2.2 |
| 65 | | A5 | 52.0 | 8.48 | 9.0 | 3.5 | 17 | 0.3 | 0.9 | 2.2 |
| 66 | | A6 | | 8.49 | 2.6 | 3.5 | 17 | 0.3 | 0.9 | 2.2 |
| 67 | | B0 | 35.0 | 8.48 | 3.0 | 5.0 | 25 | 0.1 | 0.3 | 0.7 |
| 68 | | B1 | 21.0 | 8.48 | 2.8 | 3.8 | 20 | 0.3 | 1.1 | 2.3 |
| 69 | | B21 | 47.0 | 8.48 | 3.0 | 4.5 | 20 | 0.9 | 1.3 | 2.0 |
| 70 | | B31 | | 8.48 | 2.8 | 3.8 | 20 | 0.2 | 0.9 | 2.3 |
| 71 | | B32 | | 8.48 | 3.5, Mixed Grain Size | 3.5 | 20 | 0.3 | 0.8 | 2.3 |
| 72 | | B41 | 27.0 | 8.48 | 3.4 | 6.0 | 20 | 0.1 | 0.3 | 2.3 |
| 73 | | B42 | 50.0 | 8.48 | 4, Mixed Grain Size | 15.0 | 20 | 0.0 | 0.2 | 2.3 |

TABLE 5-continued

| | | | | | | | | | | |
|---|---|---|---|---|---|---|---|---|---|---|
| 74 | | B43 | 16.0 | 8.48 | 3.0 | 4.0 | 20 | 0.2 | 0.7 | 2.3 |
| N10 | | B44 | | 8.50 | 3.3 | 4.0 | 20 | 0.2 | 0.6 | 2.3 |
| N11 | | B45 | 9.0 | 8.48 | 1.8 | 2.5 | 20 | 1.1 | 1.6 | 2.3 |
| N12 | | B46 | | 8.48 | 1.8 | 2.3 | 20 | 1.1 | 1.5 | 2.3 |
| 75 | 7 | A1 | 15.0 | 8.48 | 2.8 | 3.5 | 20 | 0.2 | 0.6 | 1.4 |

| | Properties After Finish Cold-Rolling | | | | | | | | |
|---|---|---|---|---|---|---|---|---|---|
| | | | | | | Bending Workability | | | |
| Test No. | Tensile Strength N/mm$^2$ | Proof Strength N/mm$^2$ | Elongation % | Conductivity % IACS | Balance Index fe | 90° Direction Bad Way | 0° Direction Good Way | Stress Relaxation Rate % | Spring Deflection Limit N/mm$^2$ |
| 51 | 620 | 583 | 5 | 24.4 | 377 | B | B | 44 | 558 |
| 52 | 583 | 537 | 8 | 23.6 | 359 | A | A | 57 | 362 |
| 53 | 603 | 563 | 7 | 23.5 | 367 | A | A | 56 | 390 |
| 54 | 597 | 558 | 4 | 23.7 | 355 | C | A | | 345 |
| 55 | 590 | 551 | 6 | 23.5 | 357 | A | A | | 391 |
| 56 | 584 | 544 | 4 | 23.4 | 345 | B | A | | 376 |
| 57 | 585 | 550 | 5 | 23.5 | 350 | A | A | 58 | 382 |
| 58 | 570 | 532 | 4 | 23.5 | 338 | B | A | | 366 |
| 59 | 595 | 559 | 7 | 23.6 | 363 | A | A | | 380 |
| N9 | 608 | 568 | 7 | 23.4 | 369 | B | A | 45 | 533 |
| 60 | 604 | 560 | 6 | 24.1 | 371 | A | A | 57 | 397 |
| 61 | 617 | 575 | 4 | 24.1 | 371 | B | A | 59 | 418 |
| 62 | 636 | 593 | 2 | 24.2 | 376 | C | C | 60 | 427 |
| 63 | 609 | 562 | 4 | 24.3 | 368 | C | B | | 377 |
| 64 | 584 | 538 | 7 | 24.1 | 362 | A | A | 56 | 344 |
| 65 | 533 | 477 | 7 | 24.1 | 330 | A | A | | 258 |
| 66 | 615 | 578 | 4 | 24.9 | 376 | B | A | 46 | 524 |
| 67 | 584 | 539 | 8 | 24.2 | 366 | A | A | 56 | |
| 68 | 601 | 560 | 6 | 24.1 | 369 | A | A | 57 | |
| 69 | 594 | 558 | 4 | 24.3 | 359 | C | B | | |
| 70 | 590 | 552 | 5 | 24.0 | 358 | A | A | | |
| 71 | 563 | 520 | 4 | 24.1 | 339 | B | A | | |
| 72 | 584 | 542 | 5 | 24.0 | 354 | A | A | 57 | |
| 73 | 567 | 533 | 3 | 24.1 | 338 | B | B | | |
| 74 | 593 | 556 | 7 | 24.2 | 368 | A | A | | |
| N10 | 591 | 552 | 8 | 23.3 | 362 | B | A | 47 | 510 |
| N11 | 627 | 575 | 4 | 23.4 | 372 | C | B | | 405 |
| N12 | 630 | 580 | 4 | 23.4 | 374 | C | B | 61 | |
| 75 | 592 | 548 | 7 | 24.7 | 371 | A | A | | |

TABLE 6

| | | | | | Average Grain Size | | | Area Ratio of β Phase + γ Phase | | |
|---|---|---|---|---|---|---|---|---|---|---|
| Test No. | Alloy No. | Process No. | Average Particle Size of Precipitate After Recrystallization Heat Treatment Process nm | Density g/cm$^3$ | After Finish Cold-Rolling μm | After Annealing Process μm | After Hot-Rolling μm | After Finish Cold-Rolling % | After Annealing Process % | After Hot-Rolling % |
| 76 | 7 | A2 | | 8.48 | 2.2 | 3.5 | 20 | 0.3 | 0.6 | 1.4 |
| 77 | | A5 | | 8.48 | 10.0 | 3.5 | 20 | 0.0 | 0.6 | 1.4 |
| 78 | 8 | A1 | 13.0 | 8.50 | 2.7 | 3.2 | 17 | 0.0 | 0.3 | 0.6 |
| 79 | | A2 | | 8.50 | 2.2 | 3.2 | 17 | 0.2 | 0.3 | 0.6 |
| 80 | | A4 | 4.0 | 8.50 | 1.6 | 3.2 | 17 | 0.2 | 0.3 | 0.6 |
| 81 | | A3 | | 8.50 | 3.5 | 3.2 | 17 | 0.0 | 0.3 | 0.6 |
| 82 | | A5 | | 8.50 | 8.5 | 3.2 | 17 | 0.0 | 0.3 | 0.6 |
| 83 | | A6 | | 8.50 | 2.7 | 3.2 | 17 | 0.0 | 0.3 | 0.6 |
| N13 | 9 | A1 | 22.0 | 8.52 | 3.5 | 4.5 | 17 | 0.3 | 0.9 | 2.4 |
| N14 | | A2 | 13.0 | 8.52 | 2.8 | 4.5 | 17 | 0.4 | 0.9 | 2.4 |
| N15 | | A4 | 9.0 | 8.52 | 1.9 | 4.5 | 17 | 0.7 | 0.9 | 2.3 |
| N16 | | A41 | | 8.52 | 1.9 | 4.5 | 17 | 0.6 | 0.9 | 2.4 |
| N17 | | A3 | 38.0 | 8.52 | 4.5 | 4.5 | 17 | 0.1 | 0.9 | 2.4 |
| N18 | | A5 | 62.0 | 8.52 | 8.0 | 4.5 | 17 | 0.3 | 0.9 | 2.4 |
| N19 | | A6 | | 8.53 | 3.5 | 4.5 | 17 | 0.3 | 0.9 | 2.4 |
| N20 | | B0 | 42.0 | 8.52 | 3.8 | 6.0 | 23 | 0.0 | 0.2 | 0.7 |
| N21 | | B1 | 24.0 | 8.52 | 3.5 | 4.5 | 17 | 0.3 | 0.9 | 2.5 |
| N22 | | B21 | 56.0 | 8.52 | 3.8 | 4.5 | 17 | 0.9 | 1.2 | 2.1 |
| N23 | | B31 | | 8.52 | 3.5 | 4.5 | 17 | 0.4 | 0.8 | 2.5 |
| N24 | | B32 | | 8.52 | 4, Mixed Grain Size | 4.2 | 17 | 0.5 | 0.9 | 2.5 |

TABLE 6-continued

| | | | | | | | | | | |
|---|---|---|---|---|---|---|---|---|---|---|
| N25 | | B41 | 36.0 | 8.52 | 3.7 | 6.0 | 17 | 0.0 | 0.4 | 2.5 |
| N26 | | B42 | 60.0 | 8.52 | 4.5, Mixed Grain Size | 15.0 | 17 | 0.1 | 0.3 | 2.5 |
| N27 | | B43 | 25.0 | 8.52 | 3.5 | 4.5 | 17 | 0.3 | 0.8 | 2.5 |
| N28 | | B44 | | 8.53 | 3.3 | 4.2 | 17 | 0.2 | 0.8 | 2.5 |
| N29 | | B45 | 16.0 | 8.52 | 2.2 | 2.5 | 17 | 1.2 | 1.6 | 2.5 |
| N30 | | B46 | 12.0 | 8.52 | 2.0 | 2.5 | 17 | 1.2 | 1.7 | 2.5 |
| N31 | 10A | A1 | 20.0 | 8.54 | 3.2 | 4.0 | 20 | 0.1 | 0.4 | 1.3 |
| N32 | | A2 | 12.0 | 8.54 | 3.0 | 4.0 | 20 | 0.3 | 0.4 | 1.3 |
| N33 | | A4 | 7.0 | 8.54 | 2.2 | 4.0 | 20 | 0.3 | 0.4 | 1.3 |

| | Properties After Finish Cold-Rolling | | | | | | | | |
|---|---|---|---|---|---|---|---|---|---|
| | | | | | | Bending Workability | | | |
| Test No. | Tensile Strength N/mm$^2$ | Proof Strength N/mm$^2$ | Elongation % | Conductivity % IACS | Balance Index fe | 90° Direction Bad Way | 0° Direction Good Way | Stress Relaxation Rate % | Spring Deflection Limit N/mm$^2$ |
| 76 | 604 | 566 | 6 | 24.7 | 375 | B | A | | |
| 77 | 514 | 467 | 8 | 24.8 | 326 | A | A | | |
| 78 | 590 | 552 | 7 | 24.5 | 368 | A | A | | |
| 79 | 601 | 557 | 6 | 24.5 | 371 | A | A | | |
| 80 | 619 | 568 | 2 | 24.5 | 368 | C | A | | |
| 81 | 577 | 530 | 8 | 24.5 | 363 | A | A | | |
| 82 | 526 | 477 | 10 | 24.5 | 337 | A | A | | |
| 83 | 601 | 573 | 5 | 25.3 | 373 | A | A | | |
| N13 | 597 | 550 | 8 | 23.0 | 363 | A | A | 42 | 400 |
| N14 | 612 | 572 | 6 | 23.0 | 365 | B | A | 46 | 422 |
| N15 | 629 | 582 | 4 | 23.1 | 369 | C | B | 48 | 433 |
| N16 | 605 | 555 | 8 | 23.2 | 369 | C | A | | 387 |
| N17 | 578 | 532 | 9 | 23.0 | 355 | A | A | 40 | 355 |
| N18 | 538 | 483 | 9 | 23.0 | 330 | A | A | | 278 |
| N19 | 615 | 570 | 5 | 23.5 | 367 | B | A | 21 | 540 |
| N20 | 570 | 527 | 9 | 23.2 | 351 | A | A | 46 | 345 |
| N21 | 590 | 545 | 9 | 23.0 | 362 | A | A | 42 | 400 |
| N22 | 583 | 544 | 5 | 23.2 | 346 | C | B | | 344 |
| N23 | 578 | 535 | 7 | 23.0 | 348 | A | A | 45 | 380 |
| N24 | 568 | 521 | 6 | 23.0 | 339 | C | A | | 350 |
| N25 | 575 | 526 | 8 | 22.9 | 349 | A | A | 40 | 365 |
| N26 | 550 | 505 | 5 | 23.0 | 325 | B | A | | 360 |
| N27 | 591 | 547 | 9 | 23.1 | 363 | A | A | 42 | 388 |
| N28 | 604 | 565 | 6 | 23.5 | 364 | B | A | 21 | 545 |
| N29 | 622 | 577 | 5 | 23.0 | 368 | C | B | | 425 |
| N30 | 624 | 576 | 5 | 23.0 | 369 | C | B | 48 | 518 |
| N31 | 610 | 563 | 8 | 22.5 | 366 | A | A | 46 | 390 |
| N32 | 618 | 560 | 7 | 22.5 | 367 | A | A | 48 | |
| N33 | 622 | 569 | 5 | 22.6 | 364 | C | B | | |

TABLE 7

| | | | | | Average Grain Size | | | Area Ratio of β Phase + γ Phase | | |
|---|---|---|---|---|---|---|---|---|---|---|
| Test No. | Alloy No. | Process No. | Average Particle Size of Precipitate After Recrystallization Heat Treatment Process nm | Density g/cm$^3$ | After Finish Cold-Rolling μm | After Annealing Process μm | After Hot-Rolling μm | After Finish Cold-Rolling % | After Annealing Process % | After Hot-Rolling % |
| N34 | 10A | A41 | | 8.54 | 2.2 | 4.0 | 20 | 0.3 | 0.4 | 1.3 |
| N35 | | A3 | 35.0 | 8.54 | 5.0 | 4.0 | 20 | 0.0 | 0.4 | 1.3 |
| N36 | | A5 | 53.0 | 8.54 | 9.0 | 4.0 | 20 | 0.2 | 0.4 | 1.3 |
| N37 | | A6 | | 8.55 | 3.2 | 4.0 | 20 | 0.1 | 0.4 | 1.3 |
| N38 | | B44 | | 8.54 | 3.3 | 4.0 | 20 | 0.1 | 0.3 | 1.3 |
| N39 | 10B | A1 | 15.0 | 8.53 | 2.8 | 3.5 | 17 | 0.0 | 0.4 | 1.1 |
| N40 | | A2 | 11.0 | 8.53 | 2.3 | 3.5 | 17 | 0.2 | 0.4 | 1.1 |
| N41 | | A4 | 5.0 | 8.53 | 1.8 | 3.5 | 17 | 0.3 | 0.4 | 1.1 |
| N42 | | A41 | | 8.53 | 1.8 | 3.5 | 17 | 0.3 | 0.4 | 1.1 |
| N43 | | A3 | 28.0 | 8.53 | 3.5 | 3.5 | 17 | 0.0 | 0.4 | 1.1 |
| N44 | | A5 | 50.0 | 8.53 | 8.0 | 3.5 | 17 | 0.0 | 0.4 | 1.1 |
| N45 | | A6 | | 8.54 | 2.8 | 3.5 | 17 | 0.0 | 0.4 | 1.1 |
| N46 | | B0 | 36.0 | 8.53 | 3.5 | 4.5 | 25 | 0.0 | 0.0 | 0.4 |
| N47 | | B1 | 18.0 | 8.53 | 2.8 | 3.5 | 20 | 0.1 | 0.4 | 1.1 |
| N48 | | B21 | 48.0 | 8.53 | 3.0 | 3.5 | 20 | 0.4 | 0.6 | 1.0 |
| N49 | | B31 | | 8.53 | 3.0 | 3.2 | 20 | 0.1 | 0.3 | 1.2 |

TABLE 7-continued

| | | | | | | | | | | |
|---|---|---|---|---|---|---|---|---|---|---|
| N50 | | B32 | | 8.53 | 3.5, Mixed Grain Size | 3.0 | 20 | 0.1 | 0.3 | 1.1 |
| N51 | | B41 | 30.0 | 8.53 | 3.3 | 5.5 | 20 | 0.0 | 0.2 | 1.1 |
| N52 | | B42 | 52.0 | 8.53 | 4, Mixed Grain Size | 12.0 | 20 | 0.0 | 0.1 | 1.1 |
| N53 | | B43 | 22.0 | 8.53 | 2.8 | 3.5 | 20 | 0.0 | 0.3 | 1.1 |
| N54 | | B44 | | 8.54 | 2.8 | 3.5 | 20 | 0.0 | 0.3 | 1.1 |
| N55 | | B45 | 14.0 | 8.53 | 2.0 | 2.3 | 20 | 0.6 | 0.8 | 1.1 |
| N56 | | B46 | 8.0 | 8.53 | 2.0 | 2.3 | 20 | 0.6 | 0.8 | 1.1 |
| 84 | 11 | C1 | | 8.52 | 5.0 | 5.5 | 20 | 0.0 | 0.0 | 0.3 |
| 85 | 12 | C1 | | 8.47 | 4.5 | 6.0 | 23 | 0.1 | 0.4 | 0.8 |
| 86 | 13 | C1 | | 8.48 | 4.8 | 6.5 | 23 | 0.2 | 0.4 | 1.2 |
| 87 | 14 | C1 | | 8.49 | 2.7 | 3.5 | 15 | 0.0 | 0.3 | 0.5 |
| N57 | | C2 | | 8.49 | 2.7 | 3.5 | 15 | 0.0 | 0.3 | 0.5 |
| N58 | 14A | C1 | | 8.49 | 2.2 | 3.0 | 12 | 0.0 | 0.3 | 0.5 |
| 88 | 15 | C1 | | 8.47 | 3.0 | 4.0 | 17 | 0.2 | 0.4 | 1.0 |

| | Properties After Finish Cold-Rolling | | | | | | | | |
|---|---|---|---|---|---|---|---|---|---|
| | | | | | | Bending Workability | | | |
| Test No. | Tensile Strength N/mm$^2$ | Proof Strength N/mm$^2$ | Elongation % | Conductivity % IACS | Balance Index fe | 90° Direction Bad Way | 0° Direction Good Way | Stress Relaxation Rate % | Spring Deflection Limit N/mm$^2$ |
| N34 | 607 | 554 | 7 | 22.7 | 362 | B | A | | |
| N35 | 580 | 532 | 9 | 22.5 | 351 | A | A | 45 | |
| N36 | 538 | 482 | 8 | 22.5 | 323 | A | A | | |
| N37 | 615 | 570 | 6 | 23.1 | 366 | A | A | 28 | 540 |
| N38 | 620 | 575 | 6 | 23.2 | 371 | A | A | 29 | 545 |
| N39 | 605 | 566 | 8 | 23.1 | 368 | A | A | 45 | 398 |
| N40 | 616 | 572 | 6 | 23.1 | 368 | B | A | 47 | 416 |
| N41 | 633 | 580 | 3 | 23.1 | 367 | C | C | 49 | 425 |
| N42 | 617 | 565 | 6 | 23.3 | 370 | C | A | | 395 |
| N43 | 589 | 536 | 9 | 23.2 | 363 | A | A | 43 | 350 |
| N44 | 538 | 485 | 9 | 23.3 | 332 | A | A | | 277 |
| N45 | 620 | 582 | 5 | 23.5 | 370 | B | A | 26 | 553 |
| N46 | 584 | 540 | 8 | 23.1 | 355 | A | A | 49 | 362 |
| N47 | 603 | 564 | 8 | 23.1 | 367 | A | A | 45 | 390 |
| N48 | 587 | 549 | 5 | 23.3 | 349 | B | A | | 345 |
| N49 | 590 | 547 | 6 | 23.2 | 353 | A | A | 48 | 388 |
| N50 | 578 | 532 | 4 | 23.1 | 339 | C | A | | 376 |
| N51 | 584 | 532 | 9 | 23.2 | 359 | A | A | 44 | 382 |
| N52 | 559 | 511 | 7 | 23.2 | 338 | B | A | | 360 |
| N53 | 600 | 558 | 8 | 23.3 | 367 | A | A | 46 | 390 |
| N54 | 617 | 566 | 6 | 23.7 | 373 | B | A | 26 | 544 |
| N55 | 622 | 570 | 4 | 23.3 | 366 | B | B | | 405 |
| N56 | 623 | 574 | 4 | 23.2 | 366 | C | B | 50 | 408 |
| 84 | 548 | 510 | 9 | 24.3 | 346 | A | A | 62 | 365 |
| 85 | 572 | 536 | 8 | 24.0 | 357 | A | A | 64 | 377 |
| 86 | 554 | 510 | 9 | 23.9 | 348 | A | A | 66 | 368 |
| 87 | 584 | 546 | 6 | 24.5 | 361 | A | A | 57 | 380 |
| N57 | 596 | 554 | 5 | 24.8 | 367 | A | A | 45 | 522 |
| N58 | 598 | 554 | 5 | 24.5 | 366 | B | A | | |
| 88 | 590 | 554 | 6 | 24.8 | 368 | A | A | 58 | 383 |

TABLE 8

| | | | | | Average Grain Size | | | Area Ratio of β Phase + γ Phase | | |
|---|---|---|---|---|---|---|---|---|---|---|
| Test No. | Alloy No. | Process No. | Average Particle Size of Precipitate After Recrystallization Heat Treatment Process nm | Density g/cm$^3$ | After Finish Cold-Rolling μm | After Annealing Process μm | After Hot-Rolling μm | After Finish Cold-Rolling % | After Annealing Process % | After Hot-Rolling % |
| 89 | 16 | C1 | 30.0 | 8.47 | 3.5 | 5.0 | 17 | 0.4 | 0.7 | 1.7 |
| N59 | | C2 | | 8.47 | 3.5 | 5.0 | 17 | 0.4 | 0.7 | 1.7 |
| N60 | 17 | C1 | 18.0 | 8.53 | 3.2 | 4.0 | 20 | 0.0 | 0.1 | 0.5 |
| N61 | | C2 | | 8.53 | 3.2 | 4.0 | 20 | 0.0 | 0.1 | 0.5 |
| N62 | 18 | C1 | 13.0 | 8.48 | 2.5 | 3.3 | 15 | 0.3 | 1.0 | 2.4 |
| N63 | | C2 | | 8.49 | 2.5 | 3.3 | 15 | 0.3 | 1.0 | 2.4 |
| N64 | 19 | C1 | 17.0 | 8.53 | 2.7 | 3.5 | 17 | 0.4 | 1.1 | 2.6 |
| N65 | | C2 | | 8.54 | 2.7 | 3.5 | 17 | 0.4 | 1.1 | 2.6 |
| N66 | 20 | C1 | 7.0 | 8.50 | 2.3 | 3.0 | 15 | 0.0 | 0.3 | 0.6 |

TABLE 8-continued

| | | | | | | | | | | |
|---|---|---|---|---|---|---|---|---|---|---|
| N67 | | C2 | | 8.51 | 2.3 | 3.0 | 15 | 0.0 | 0.3 | 0.6 |
| N68 | 20A | C1 | 9.0 | 8.53 | 2.5 | 3.5 | 15 | 0.0 | 0.3 | 0.7 |
| N69 | | C2 | | 8.54 | 2.5 | 3.5 | 15 | 0.0 | 0.3 | 0.7 |
| N70 | 20B | C1 | 6.0 | 8.48 | 2.2 | 3.0 | 15 | 0.3 | 0.7 | 1.7 |
| N71 | | C2 | | 8.48 | 2.2 | 3.0 | 15 | 0.3 | 0.7 | 1.7 |
| 90 | 21 | C1 | | 8.48 | 3.0 | 4.0 | 17 | 0.4 | 0.8 | 1.9 |
| 91 | 22 | C1 | | 8.48 | 8.5 | 12.0 | 25 | 0.0 | 0.3 | 0.6 |
| 92 | 23 | C1 | 70.0 | 8.48 | 8.0 | 10.0 | 25 | 0.1 | 0.4 | 0.8 |
| 93 | 24 | C1 | 3.8 | 8.47 | 1.9 | 2.5 | 15 | 0.3 | 0.7 | 2.0 |
| 94 | 25 | C1 | 3.8 | 8.48 | 1.9 | 2.3 | 12 | 0.4 | 0.9 | 2.3 |
| 95 | 26 | C1 | | 8.45 | 5.2 | 6.0 | 20 | 0.9 | 1.8 | 4.0 |
| 96 | 27 | C1 | | 8.57 | 6.5 | 7.5 | 23 | 0.0 | 0.0 | 0.0 |
| 97 | 28 | C1 | | 8.51 | 3.0 | 4.0 | 17 | 1.2 | 1.6 | 3.5 |
| 98 | 29 | C1 | | 8.46 | 3.3 | 5.0 | 20 | 1.5 | 2.1 | 5.0 |
| 99 | 30 | C1 | | 8.49 | 6.0 | 8.0 | 25 | 0.0 | 0.0 | 0.5 |
| 100 | 31 | C1 | | 8.51 | 5.0 | 6.5 | 20 | 0.0 | 0.0 | 0.3 |
| 101 | 32 | C1 | | 8.46 | 2.8 | 4.0 | 15 | 1.7 | 2.5 | 5.5 |
| 102 | 33 | C1 | | 8.48 | 2.8 | 4.0 | 20 | 1.3 | 1.8 | 4.8 |

| | Properties After Finish Cold-Rolling | | | | | | | | |
|---|---|---|---|---|---|---|---|---|---|
| | | | | | | Bending Workability | | | |
| Test No. | Tensile Strength N/mm$^2$ | Proof Strength N/mm$^2$ | Elongation % | Conductivity % IACS | Balance Index fe | 90° Direction Bad Way | 0° Direction Good Way | Stress Relaxation Rate % | Spring Deflection Limit N/mm$^2$ |
| 89 | 571 | 528 | 7 | 23.3 | 348 | A | A | 59 | 375 |
| N59 | 595 | 546 | 4 | 23.7 | 356 | B | A | 48 | 538 |
| N60 | 572 | 526 | 9 | 23.1 | 351 | A | A | 46 | 380 |
| N61 | 585 | 543 | 7 | 23.6 | 356 | A | A | 24 | 525 |
| N62 | 604 | 566 | 7 | 23.1 | 366 | A | A | 47 | 398 |
| N63 | 611 | 570 | 6 | 23.4 | 369 | B | A | 27 | 552 |
| N64 | 597 | 550 | 8 | 22.6 | 359 | A | A | 43 | 400 |
| N65 | 608 | 560 | 6 | 23.0 | 362 | B | A | 22 | 545 |
| N66 | 603 | 550 | 8 | 24.5 | 379 | A | A | 58 | 405 |
| N67 | 614 | 565 | 7 | 24.9 | 385 | B | A | 47 | 550 |
| N68 | 610 | 560 | 7 | 23.4 | 370 | A | A | 46 | 411 |
| N69 | 624 | 574 | 5 | 23.8 | 374 | B | A | 29 | 555 |
| N70 | 618 | 572 | 6 | 24.0 | 378 | A | A | 59 | 427 |
| N71 | 630 | 584 | 4 | 24.6 | 383 | B | A | 48 | 568 |
| 90 | 601 | 552 | 4 | 23.8 | 360 | C | B | | |
| 91 | 523 | 479 | 9 | 24.1 | 330 | A | A | 71 | 335 |
| 92 | 522 | 480 | 9 | 24.3 | 331 | A | A | 72 | 328 |
| 93 | 618 | 570 | 3 | 24.2 | 370 | C | C | | |
| 94 | 627 | 579 | 4 | 22.9 | 368 | C | B | 62 | |
| 95 | 561 | 520 | 3 | 24.2 | 336 | C | B | 70 | 345 |
| 96 | 527 | 483 | 9 | 24.6 | 332 | A | A | | 334 |
| 97 | 605 | 558 | 4 | 22.8 | 353 | C | B | 71 | |
| 98 | 607 | 557 | 3 | 23.7 | 360 | C | C | 74 | 337 |
| 99 | 531 | 487 | 8 | 24.4 | 334 | A | A | 65 | 324 |
| 100 | 537 | 490 | 6 | 24.5 | 331 | A | A | | 319 |
| 101 | 609 | 556 | 3 | 25.5 | 374 | C | C | 70 | |
| 102 | 616 | 570 | 3 | 24.0 | 367 | C | B | 55 | |

TABLE 9

| | | | | | | | | | | |
|---|---|---|---|---|---|---|---|---|---|---|
| | | | Average Particle Size of | | Average Grain Size | | | Area Ratio of β Phase + γ Phase | | |
| Test No. | Alloy No. | Process No. | Precipitate After Recrystallization Heat Treatment Process nm | Density g/cm$^3$ | After Finish Cold-Rolling μm | After Annealing Process μm | After Hot-Rolling μm | After Finish Cold-Rolling % | After Annealing Process % | After Hot-Rolling % |
| N72 | 34 | C1 | | 8.53 | 3.0 | 4.0 | 20 | 1.2 | 1.7 | 4.5 |
| N73 | | C2 | | 8.54 | 3.0 | 4.0 | 20 | 1.2 | 1.7 | 4.5 |
| N74 | 35 | C1 | 5.0 | 8.50 | 2.3 | 3.5 | 20 | 0.1 | 0.4 | 4.8 |
| N75 | | C2 | | 8.51 | 2.3 | 3.5 | 20 | 0.1 | 0.4 | 4.8 |
| N76 | 36 | C1 | 40.0 | 8.54 | 5.5 | 8.0 | 20 | 0.0 | 0.2 | 0.6 |
| N77 | | C2 | | 8.54 | 5.5 | 8.0 | 20 | 0.0 | 0.2 | 0.6 |
| N78 | 37 | C1 | | 8.52 | 6.5 | 9.0 | 20 | 0.0 | 0.2 | 0.6 |
| N79 | | C2 | | 8.53 | 6.5 | 9.0 | 20 | 0.0 | 0.2 | 0.6 |
| N80 | 38 | C1 | 3.3 | 8.49 | 1.8 | 2.5 | 15 | 0.1 | 0.3 | 0.7 |

TABLE 9-continued

| | | | | | | | | | | |
|---|---|---|---|---|---|---|---|---|---|---|
| N81 | 39 | C1 | 3.7 | 8.48 | 1.8 | 2.3 | 13 | 0.2 | 0.4 | 0.9 |
| N82 | 40 | C1 | 70.0 | 8.48 | 7.0 | 10.0 | 20 | 0.2 | 0.4 | 0.9 |
| N83 | 41 | C1 | | 8.46 | 6.5 | 10.0 | 20 | 0.0 | 0.4 | 0.7 |
| N84 | 42 | C1 | | 8.58 | 6.0 | 12.0 | 30 | 0.0 | 0.0 | 0.3 |

| | Properties After Finish Cold-Rolling | | | | | | | | |
|---|---|---|---|---|---|---|---|---|---|
| | | | | | | Bending Workability | | | |
| Test No. | Tensile Strength N/mm$^2$ | Proof Strength N/mm$^2$ | Elongation % | Conductivity % IACS | Balance Index fe | 90° Direction Bad Way | 0° Direction Good Way | Stress Relaxation Rate % | Spring Deflection Limit N/mm$^2$ |
| N72 | 615 | 568 | 4 | 23.0 | 360 | C | B | 57 | |
| N73 | 622 | 575 | 3 | 23.3 | 362 | C | C | 42 | |
| N74 | 607 | 560 | 5 | 23.6 | 364 | B | A | 54 | |
| N75 | 618 | 573 | 4 | 23.9 | 369 | C | B | 41 | |
| N76 | 542 | 490 | 8 | 23.0 | 329 | A | A | 55 | |
| N77 | 549 | 508 | 7 | 23.0 | 330 | B | A | 43 | |
| N78 | 530 | 481 | 8 | 23.0 | 322 | A | A | 59 | |
| N79 | 543 | 584 | 6 | 23.4 | 326 | B | A | 44 | |
| N80 | 622 | 565 | 3 | 23.9 | 369 | C | C | 64 | |
| N81 | 628 | 570 | 3 | 23.8 | 372 | C | C | 65 | |
| N82 | 530 | 492 | 5 | 23.8 | 320 | C | A | 70 | |
| N83 | 526 | 465 | 7 | 25.8 | 338 | B | A | 74 | |
| N84 | 554 | 500 | 7 | 22.8 | 330 | A | A | 51 | |

A tensile strength, a proof strength, and elongation were measured using a method defined in JIS Z 2201 and JIS Z 2241, and No. 5 test piece was used regarding a shape of a test piece.

Conductivity was measured using a conductivity measuring device (SIGMATEST D2.068, manufactured by Foerster Japan Ltd.). In this specification, "electric conduction" has the same definition as that of "conduction". In addition, thermal conduction has a strong relationship with electric conduction. Therefore, the higher the electric conductivity, the higher the thermal conductivity.

Bending workability was evaluated in a W bending test defined in JIS H 3110. The bending (W-bending) test was performed as follows. A bending radius (R) of a front end of a bending fixture was set to be 0.67 times (0.3 mm×0.67 mm=0.201 mm, bending radius=0.2 mm) the thickness of a material or to be 0.33 times (0.3 mm×0.33 mm=0.099 mm, bending radius=0.1 mm) the thickness of a material. Samples were bent in a direction, so-called bad way, which forms 90 degrees with a rolling direction and in a direction, so-called good way, which forms 0 degrees with the rolling direction. In the evaluation of bending workability, whether there were cracks or not was determined by observation using a stereoscopic microscope at 20 magnifications. A sample where cracks were not formed when a bending radius was 0.33 times the thickness of a material was evaluated as A, a sample where cracks were not formed when a bending radius was 0.67 times the thickness of a material was evaluated as B, and a sample where cracks were formed when a bending radius was 0.67 times the thickness of a material was evaluated as C.

A spring deflection limit was measured using a method defined in JIS H 3130 and was evaluated in a repetitive bending test. The test was carried out until a permanent deflection exceeds 0.1 mm.

An average grain size of recrystallized grains was measured according to planimetry of methods for estimating average grain size of wrought copper and copper alloys defined in JIS H 0501 by selecting an appropriate magnification according to the size of crystal grains based on metallographic microscopic images of, for example, 600 magnifications, 300 magnifications, and 150 magnifications. Twin crystal was not considered a crystal grain. When the average grain size was difficult to determine using a metallographic microscope, the average grain size was obtained using the FE-SEM-EBSP (Electron Back Scattering diffraction Pattern) method. That is, by using JSM-7000F (manufactured by JEOL Ltd.) as a FE-SEM and using OIM-Ver. 5.1 (manufactured by TSL solutions Ltd.) for analysis, an average grain size was obtained from grain maps at analysis magnifications of 200 times and 500 times. The average grain size was calculated according to planimetry (JIS H 0501).

One crystal grain is grown by rolling, but the volume of crystal grains is not substantially changed by rolling. In cross-sections obtained by cutting a sheet material in directions parallel to and perpendicular to a rolling direction, when an average value of the respective average grain sizes which are measured according to planimetry is obtained, an average grain size in the stage of recrystallization can be estimated.

Area ratios of β and γ phases were obtained using the FE-SEM-EBSP method. By using JSM-7000F (manufactured by JEOL Ltd.) as a FE-SEM and using OIM-Ver. 5.1 (manufactured by TSL solutions Ltd.) for analysis, the area ratios were obtained from phase maps at analysis magnifications of 200 times and 500 times.

A stress relaxation rate was measured as follows. In a stress relaxation test of a test material, a cantilever screw jig was used. A test piece was collected from a direction forming 0° (parallel to) with a rolling direction and had a shape of thickness t×width 10 mm×length 60 mm. In the manufacturing processes A1, A31, B1, and C1, a test piece was collected from a direction forming 90° (perpendicular to) with a rolling direction for the test. A load stress on the test material was set to be 80% with respect to a proof strength of 0.2%, and the test material was exposed to an atmosphere of 120° C. for 1000 hours. A stress relaxation rate was obtained from the following expression.

$$\text{Stress Relaxation Rate}=(\text{Displacement After Relief}/\text{Displacement under Load Stress})\times 100(\%)$$

Samples were collected from both directions forming 0° (parallel to) and 90° (perpendicular to) in a rolling direction. The samples were tested using the test pieces collected from both the directions parallel to and perpendicular to the rolling direction. An average stress relaxation rate of the test results was obtained.

In the evaluation of stress relaxation characteristics, the greater the numerical value of a stress relaxation rate, the poorer the stress relaxation characteristics. In general, stress relaxation characteristics are particularly poor at greater than 70%, poor at greater 50%, normal at 30% to 50%, satisfactory at 20% to 30%, and excellent at less than 20%. In a satisfactory range from 20% to 30%, the smaller the numerical value, the more satisfactory the stress relaxation characteristics.

An average particle size of a precipitate was obtained as follows. Transmission electronic microscopic images were obtained using a TEM at 500,000 magnifications and 150,000 magnifications (detection limits were 1.0 nm and 3 nm, respectively), and the contrast of a precipitate was elliptically approximated using an image analysis software "Win ROOF". A geometric mean of long and short axes was obtained from each of all the precipitate particles in the field of view, and an average value of the geometric means was obtained as an average particle size. In the measurements at 500,000 magnifications and 150,000 magnifications, particle size detection limits were 1.0 nm and 3 nm, respectively, and particles having a size less than the detection limits were considered noises and not included in the calculation of the average particle size. Using approximately 8 nm as a boundary size, the average particle size was measured at 500,000 times when precipitate particles had a size of 8 nm or less; and was measured at 150,000 times when precipitate particles had a size of 8 nm or greater. In the case of a transmission electron microscope, since a cold-rolled material has a high dislocation density, it is difficult to accurately obtain precipitate information. In addition, the size of a precipitate is not changed by cold-rolling. Therefore, in this observation, recrystallized portions after the recrystallization heat treatment process prior to the finish cold-rolling process were observed. Measurement positions were two ¼ thickness positions from both front and back surfaces of a rolled material. Measured values of the two positions were averaged.

The test results are shown below.

(1) Copper alloy sheets obtained by performing the cold-rolling process on the first alloy according to the invention are superior in balance between specific strength, elongation, and conductivity and in bending workability, the first alloy according to the invention being a copper alloy material in which an average grain size is 2.0 μm to 7.0 μm, and a sum of an area ratio of a β phase and an area ratio of a γ phase in a metallographic structure is 0% to 0.9% (for example, refer to Test No. 1, 16, 23, and 38).

(2) Copper alloy sheets obtained by performing the cold-rolling process on the second alloy according to the invention are superior in balance between specific strength, elongation, and conductivity and in bending workability, the second alloy according to the invention being a copper alloy material in which an average grain size is 2.0 μm to 7.0 μm, and a sum of an area ratio of a β phase and an area ratio of a γ phase in a metallographic structure is 0% to 0.9% (for example, refer to Test No. 45, 60, 75, and 78).

(3) Copper alloy sheets obtained by performing the cold-rolling process on the third alloy according to the invention are superior in balance between specific strength, elongation, and conductivity and in bending workability, the third alloy according to the invention being a copper alloy material in which an average grain size is 2.0 μm to 7.0 μm, and a sum of an area ratio of a β phase and an area ratio of a γ phase in a metallographic structure is 0% to 0.9% (for example, refer to Test No. N66).

(4) Copper alloy sheets obtained by performing the cold-rolling process on the fourth alloy according to the invention are superior in balance between specific strength, elongation, and conductivity and in bending workability, the fourth alloy according to the invention being a copper alloy material in which an average grain size is 2.0 μm to 7.0 μm, and a sum of an area ratio of a β phase and an area ratio of a γ phase in a metallographic structure is 0% to 0.9% (for example, refer to Test No. N68 and N70).

(5) Copper alloy sheets can be obtained by performing the cold-rolling process on the first to fourth alloys according to the invention which are copper alloy materials in which an average grain size is 2.0 μm to 7.0 μm, and a sum of an area ratio of a β phase and an area ratio of a γ phase in a metallographic structure is lower than or equal to 0.9%. In these copper alloy sheets, when a tensile strength is denoted by A ($N/mm^2$), an elongation is denoted by B (%), a conductivity is denoted by C (% IACS), and a density is denoted by D ($g/cm^3$), after the finish cold-rolling process, $A \geq 540$, $C \geq 21$, and $340 \leq [A \times \{(100+B)/100\} \times C^{1/2} \times 1/D$. These copper alloy sheets are superior in balance between specific strength, elongation, and conductivity (for example, refer to Test No. 1, 16, 23, 38, 45, 60, 75, 78, N66, N68, and N70).

(6) Copper alloy sheets obtained by performing the cold-rolling process and the recovery heat treatment process on the first to fourth alloys according to the invention are superior in spring deflection limit, stress relaxation characteristics, and conductivity, the first to fourth alloys according to the invention being copper alloy materials in which an average grain size is 2.0 μm to 7.0 μm, and a sum of an area ratio of a β phase and an area ratio of a γ phase in a metallographic structure is 0% to 0.9% (for example, refer to Test No. 7, 22, 29, 44, 51, 66, 83, N67, N69, and N71).

(7) Copper alloy sheets can be obtained by performing the cold-rolling process and the recovery heat treatment process on the first to fourth alloys according to the invention which are copper alloy materials in which an average grain size is 2.0 μm to 7.0 μm, and a sum of an area ratio of a β phase and an area ratio of a γ phase in a metallographic structure is lower than or equal to 0.9%. In these copper alloy sheets, when a tensile strength is denoted by A ($N/mm^2$), an elongation is denoted by B (%), a conductivity is denoted by C (% IACS), and a density is denoted by D ($g/cm^3$), after the finish cold-rolling process, $A \geq 540$, $C \geq 21$, and $340 \leq [A \times \{(100+B)/100\} \times C^{1/2} \times 1/D]$. These copper alloy sheets are superior in balance between specific strength, elongation, and conductivity (for example, refer to Test No. 7, 22, 29, 44, 51, 66, 83, N67, N69, and N71).

(8) Rolled materials according to (1) to (4) described above can be obtained using a manufacturing method under specific manufacturing conditions. This manufacturing method includes a hot-rolling process; a cold-rolling process; a recrystallization heat treatment process; and the finish cold-rolling process in this order. In this manufacturing method, a hot-rolling start temperature of the hot-rolling process is 760° C. to 850° C.; a cooling rate of a copper alloy material in a temperature range from 480° C. to 350° C. after final rolling is higher than or equal to 1° C./sec or the copper alloy material is held in a temperature range from 450° C. to 650° C. for 0.5 hours to 10 hours after final rolling; a cold-rolling ratio in the cold-rolling process is higher than or equal to 55%; the recrystallization heat treatment process includes a heating step of heating the copper alloy material to a predetermined temperature, a holding step of holding the copper alloy material at a predetermined temperature for a predetermined time after the heating step, and a cooling step of cooling the copper alloy material to a predetermined temperature after the holding step; and in the recrystallization heat treatment process, when a maximum reaching temperature of the copper alloy material is denoted by Tmax (° C.), a holding time in a temperature range from a temperature, which is 50° C. lower than the maximum reaching temperature of the copper alloy material, to the maximum reaching temperature is denoted by tm (min), and a cold-rolling ratio in the cold-rolling process is denoted by RE (%), $480 \leq Tmax \leq 690$, $0.03 \leq tm \leq 1.5$, and $360 \leq \{Tmax-40 \times tm^{-1/2}-50 \times (1-RE/100)^{1/2}\} \leq 520$ (for example, refer to No. 1, 16, 23, 38, 45, 60, 75, 78, N66, N68, N70).

(9) Rolled materials according to (1) to (4) described above can be obtained using a manufacturing method under specific manufacturing conditions. This manufacturing method includes a hot-rolling process; a cold-rolling process; a recrystallization heat treatment process; the finish cold-rolling process; and a recovery heat treatment process in this order. In this manufacturing method, a hot-rolling start temperature of the hot-rolling process is 760° C. to 850° C.; a cooling rate of a copper alloy material in a temperature range from 480° C. to 350° C. after final rolling is higher than or equal to 1° C./sec or the copper alloy material is held in a temperature range from 450° C. to 650° C. for 0.5 hours to 10 hours after final rolling; a cold-rolling ratio in the cold-rolling process is higher than or equal to 55%; the recrystallization heat treatment process includes a heating step of heating the copper alloy material to a predetermined temperature, a holding step of holding the copper alloy material at a predetermined temperature for a predetermined time after the heating step, and a cooling step of cooling the copper alloy material to a predetermined temperature after the holding step; in the recrystallization heat treatment process, when a maximum reaching temperature of the copper alloy material is denoted by Tmax (° C.), a holding time in a temperature range from a temperature, which is 50° C. lower than the maximum reaching temperature of the copper alloy material, to the maximum reaching temperature is denoted by tm (min), and a cold-rolling ratio in the cold-rolling process is denoted by RE (%), $480 \leq Tmax \leq 690$, $0.03 \leq tm \leq 1.5$, and $360 \leq \{Tmax-40 \times tm^{-1/2}-50 \times (1-RE/100)^{1/2}\} \leq 520$; the recovery heat treatment process includes a heating step of heating the copper alloy material to a predetermined temperature, a holding step of holding the copper alloy material at a predetermined temperature for a predetermined time after the heating step, and a cooling step of cooling the copper alloy material to a predetermined temperature after the holding step; and in the recovery heat treatment process, when a maximum reaching temperature of the copper alloy material is denoted by Tmax2 (° C.), a holding time in a temperature range from a temperature, which is 50° C. lower than the maximum reaching temperature of the copper alloy material, to the maximum reaching temperature is denoted by tm2 (min), and a cold-rolling ratio in the finish cold-rolling process is denoted by RE2(%), $120 \leq Tmax2 \leq 550$, $0.02 \leq tm2 \leq 6.0$, and $30 \leq \{Tmax2-40 \times tm2^{-1/2}-50 \times (1-RE2/100)^{1/2}\} \leq 250$ (for example, refer to No. 7, 22, 29, 44, 51, 66, 83, N67, N69, and N71).

When the alloys according to the invention are used, there are the following characteristics.

(1) Rolled sheets of the second alloy according to the invention containing Co are compared to rolled sheets of the first alloy according to the invention. Due to the addition of Co, crystal grains are refined, a tensile strength is increased, stress relaxation characteristics are superior; however, elongation deteriorates (refer to Test No. 1, 16, 23, 38, 45, 60, 75, and 78). When the Co content is 0.04 mass %, the grain growth suppressing effect is slightly excessive due to a small particle size of a precipitate and the like. As a result, an average grain size is small, and bending workability deteriorates (refer to Test No. N58).

The rolled sheets of the second alloy according to the invention containing Ni are compared to the rolled sheets of the first alloy according to the invention. Due to the addition of Ni, crystal grains are refined, and a tensile strength is increased. Stress relaxation characteristics are significantly improved. Rolled sheets of the third alloy according to the invention containing Fe are compared to the rolled sheets of the first alloy according to the invention. Due to the addition of Fe, a particle size of a precipitate is decreased, crystal grains are further refined, a tensile strength is increased; however, elongation deteriorates. By appropriately controlling the Fe content, Fe can be used instead of Co.

When an average particle size of a precipitate of an alloy containing Co, Ni, and Fe is 4 nm to 50 nm or 5 nm to 45 nm, a strength, elongation, bending workability, the balance index fe, and stress relaxation characteristics are improved. When the average particle size of the precipitate is less than 4 nm or less than 5 nm, an average grain size is decreased, elongation is decreased, and bending workability deteriorates due to the grain growth suppressing effect (manufacturing process A4). When the average particle size of the precipitate is greater than 50 nm or greater than 45 nm, the grain growth suppressing effect is decreased, and a mixed grain size state is likely to occur. In some cases, bending workability deteriorates (manufacturing process A5). When the heat treatment index It exceeds the upper limit, a particle size of a precipitate is increased. When the heat treatment index It falls below the lower limit, a particle size of a precipitate is decreased.

(2) As a sum of area ratios of β and γ phases after finish cold-rolling is higher, a tensile strength is not changed or is slightly increased; however, bending workability deteriorates. When the sum of area ratios of β and γ phases is higher than 0.9%, particularly bending workability deteriorates. As the sum of area ratios of p and γ phases is decreased, bending workability is improved (refer to Test No. 10, 12, 15, N1, and N2). When the sum of area ratios of β and γ phases is less than or equal to 0.6%, less than or equal to 0.4%, or less than or equal to 0.2%, that is, is closer to 0%, elongation and bending workability are improved, a high balance is obtained, and stress relaxation characteristics are improved (for example, refer to Test No. 60, 61, 65, and 67). When the sum of area ratios of β and γ phases is higher than 0.9%, stress relaxation characteristics are not improved that much even with the addition of Ni (refer to Test No. 102, N72, and N73).

In the recrystallization annealing process, when It is small, the sum of area ratios of β and γ phases is not decreased that much (for example, refer to Test No. 3, 18, and 62). In addition, even when It is in an appropriate range, the sum of area ratios of β and γ phases is not greatly decreased (refer to Test No. 2, 17, 61).

In the alloys according to the invention, a sum of area ratios of β and γ phases in a metallographic structure after hot-rolling is greater than 0.9% in most cases. As the sum of area ratios of β and γ phases after hot-rolling is higher, a sum of area ratios of β and γ phases after finish cold-rolling is higher. When the sum of area ratios of β and γ phases after hot-rolling is higher than 2%, β and γ phases cannot be greatly decreased in the recrystallization heat treatment process. Therefore, it is preferable that a heat treatment be performed after the heat annealing process under conditions of 480° C. and 4 hours, 520° C. and 4 hours, 580° C. and 0.2 minutes, or 560° C. and 0.4 minutes, or it is preferable that a heat treatment be performed after hot-rolling under conditions of 550° C. and 4 hours (refer to Test No. 68, 72, 74, and N10).

When Co or Ni is added, Co or Ni is combined with P to form a precipitate, and thus the grain growth suppressing effect works. Therefore, in the final recrystallization heat treatment process, even when a heat treatment is performed under conditions of a slightly high It (manufacturing process A3), an average grain size is 3 μm to 5 μm, and bending workability and stress relaxation characteristics are superior. In addition, in the previous process, when a heat treatment is performed after hot-rolling or when annealing is performed at a high temperature in the annealing process, a final average grain size is 3 μm to 4 μm. Therefore, bending workability, balance characteristics, and stress relaxation characteristics are superior. In this way, the addition of Co or Ni is particularly effective for a case where a sum of area ratios of β and γ phases after hot-rolling is high (refer to Test No. 64, 72, 74, and N10).

(3) As a grain size after finish cold-rolling is smaller, a tensile strength is increased; however, elongation, bending workability, and stress relaxation characteristics deteriorate (refer to Test No. 1 to 7 and 45 to 51).

(4) In a case where It is low in the recrystallization heat treatment process, when a cold-rolling ratio in the finish cold-rolling process is decreased, work hardening is decreased, and elongation and bending workability are improved. However, since a grain size is small and a sum of area ratios of β and γ phases is high, bending workability is still poor (refer to Test No. 4, 19, 26, 41, 48, and 63).

(5) When a grain size is great, bending workability is superior; however, a tensile strength is low, and balance between specific strength, elongation, and conductivity is poor (refer to Test No. 6, 21, 28, 43, 50, and 65).

(6) When the first composition index f1 is small, a grain size is not decreased. A grain size and a tensile strength has a strong relationship with the first composition index f1 rather than each amount of Zn and Sn (refer to Test No. 99 and 100).

(7) When a heat treatment of holding a rolled material in a temperature range from 450° C. to 650° C. for 0.5 hours to 10 hours after final hot-rolling is performed, area ratios of β and γ phases are decreased after the heat treatment and after the finish cold-rolling process, and bending workability is improved. However, since a grain size is increased by the heat treatment, a tensile strength is slightly decreased (refer to Test No. 8, 30, 52, and 67).

(8) When the annealing process is performed at a high temperature for a short period of time (580° C. and 0.2 minutes), area ratios of β and γ phases are decreased, bending workability is improved, and a decrease in tensile strength is small (refer to Test No. 15, 37, 59, and 74).

(9) When the annealing process is performed at a high temperature for a short period of time (480° C. and 0.2 minutes), area ratios of β and γ phases are not decreased due to the short period of time. Therefore, bending workability deteriorates.

(10) When the annealing process is performed for a long period of time (480° C. and 4 hours), area ratios of p and γ phases are decreased, bending workability is improved, and a decrease in tensile strength is small (refer to Test No. 1, 16, 23, 38, 45, 60, N66, and N68).

(11) When the annealing process is performed for a long period of time (390° C. and 4 hours), area ratios of p and γ phases are not decreased due to the low temperature. Therefore, bending workability deteriorates (refer to Test No. N3, N5, N8, N12, and N56).

(12) When a maximum reaching temperature in the annealing process is high (570° C.), a grain size after thee annealing process is increased even with the addition of Co or Ni. As a result, a grain size after finish cold-rolling is not decreased, precipitate particles are coarsened, a mixed grain size state occurs, and bending workability is poor (refer to Test No. 14, 36, 58, and 73).

(13) When a cold-rolling ratio in the second cold-rolling process is lower than the setting condition range, grain sizes after finish cold-rolling are in a mixed grain size state (refer to Test No. 12, 34, 56, and 71).

(14) When a cooling rate after hot-rolling is low, area ratios of β and γ phases after hot-rolling are decreased, but area ratios of β and γ phases after the finish cold-rolling process are not decreased that much. Once β and γ phases are precipitated after hot-rolling, it is difficult to eliminate the β and γ phases (refer to Test No. 10, 32, 54, and 69).

(15) In the manufacturing process A using a mass-production facility and in the manufacturing process B using an experimental facility (particularly in A1 and B1), when the manufacturing conditions are the same, the same properties are obtained (refer to Test No. 1, 9, 23, 31, 45, 53, 60, and 68).

(16) When the recovery heat treatment is performed after finish rolling, a tensile strength, a proof strength, conductivity are improved; however, workability deteriorates. In addition, a spring deflection limit is increased, and stress relaxation characteristics are improved. In particular, these properties are improved in alloys containing Ni (refer to Test No. 7, N1, 22, 29, N6, 51, N9, 66, N10, N67, N69, and N71). It is presumed that, under Sn plating conditions, the same effects can be obtained.

Regarding stress relaxation characteristics, stress relaxation characteristics of a Cu—Zn—Sn—P alloy containing Zn in a large amount of 28 mass % or greater can be significantly improved by the addition of Ni and the recovery heat treatment. In addition to these factors, when an average grain size is 3 μm to 6 μm, stress relaxation characteristics are further improved.

(17) Whether or not there is any phase other than an α phase as a matrix, a β phase, and a γ phase was determined using the FE-SEM-EBSP method. The alloys of Test No. 1 and 16 were observed in three fields of view at a magnification of 500 times. As a result, the phases other than a, β and γ phases were not observed, and materials which were considered non-metallic inclusions were observed with an area ratio of 0.2% or lower. Accordingly, it is presumed that portions other than β and γ phases were an α phase.

Regarding the composition, there are the following characteristics.

(1) When the P content is greater than the composition range of the alloys according to the invention, bending workability is poor (refer to Test No. 90). In addition, when the Co content is greater than the composition range, elongation is low, and bending workability is poor (refer to Test No. 94). In particular, an excess amount of Co decreases a grain size. In addition, when the Sn content is greater than the composition range of the alloys according to the invention, bending workability is poor (refer to Test No. 97).

(2) When the P content is less than the composition range of the alloys according to the invention, it is difficult to refine crystal grains. A tensile strength is low, and the balance index is low (refer to Test No. 91 and 92).

(3) In a case where the Zn content is greater than mass %, even if the relational expressions of the indices f1 and f2 are satisfied, an appropriate metallographic structure cannot be obtained. In addition, an average grain size is slightly great, ductility and bending workability deteriorate, a tensile strength is slightly low, and stress relaxation characteristics are poor (refer to Test No. 95).

(4) In a case where the Zn content is less than 28 mass %, even if the relational expressions of the indices f1 and f2 are satisfied, a tensile strength is low, and the balance index is low. Even with the addition of Ni, stress relaxation characteristics are not improved that much. In addition, a density exceeds 8.55, a specific strength is low, and the balance index fe is low (refer to Test No. 96 and N84).

(5) When the Sn content is greater than a predetermined value, an appropriate metallographic structure cannot be obtained, and ductility and bending workability are low. Stress relaxation characteristics are also poor. When the Sn content is less than a predetermined value, a strength is low, and stress relaxation characteristics are also poor (refer to Test No. 97 and N83).

(6) When the first composition index f1 is less than 37, it is difficult to decrease a grain size, and the amounts of solid solution strengthening and work hardening are small. Therefore, a tensile strength is low (refer to Test No. 99 and 100).

When the first composition index f1 is greater than 44, an area ratios of β and γ phases after the finish cold-rolling process is greater than 0.9%, and bending workability and stress relaxation characteristics are poor. Even with the addition of Ni, stress relaxation characteristics are not improved that much (refer to Test No. 97, N72, and N73).

As f1 becomes greater, for example, 37, 37.5, 38, and greater than 38, a grain size is decreased, and a strength is increased (refer to Test No. 85 and 87).

On the other hand, when f1 becomes smaller, for example, 44, 43, 42, and less than 42, a sum of area ratios of β and γ phases is decreased, for example, 0.6%, 0.4%, and less than 0.4%. As a result, bending workability and stress relaxation characteristics are improved (refer to Test No. N31, N37, N64, N65, and 23).

(7) When the second composition index f2 is greater than 37, a sum of area ratios of β and γ phases after the finish cold-rolling process is greater than 0.9%, and bending workability is poor (refer to Test No. 98, 101, and 102). When the second composition index f2 is less than 32, an area ratios of β and γ phases after the finish cold-rolling process is 0%, it is difficult to decrease a grain size, and the amounts of solid solution strengthening and work hardening are small. Therefore, a tensile strength is low (refer to Test No. 99 and 100).

When f2 is decreased, for example, 37, 36, 35.5, and less than 35.5, a sum of area ratios of β and γ phases is decreased, for example, 0.6%, 0.4%, and lower than 0.4%. As a result, bending workability and stress relaxation characteristics are improved (refer to Test No. 1, 16, 38, 85, N13, N19, N62, and N63).

When f2 is increased, for example, 32, 33, and greater than 33, a grain size is decreased, and a strength is increased (refer to Test No. 84).

When a ratio Ni/P is out of the range from 15 to 85, stress relaxation characteristics are not improved that much even with the addition of Ni (refer to Test No. N74, N75, N76, and N77).

When the Ni content is less than 0.5 mass %, stress relaxation characteristics are not improved that much (refer to Test No. N78 and N79).

(8) When the Fe content is greater than 0.04 mass % and the (Co+Fe) content is greater than 0.04 mass %, a particle size of a precipitate is small, and a grain size is excessively decreased. On the other hand, when Cr is added, a particle size of a precipitate is great, and a strength is decreased. Based on the above-described facts, it is presumed that properties of a precipitate are changed. Therefore, bending workability deteriorates (refer to Test No. N80, N81, and N82).

[Industrial Applicability]

The copper alloy sheet according to the invention is superior in balance between specific strength, elongation, and conductivity and in bending workability. Therefore, the copper alloy sheet according to the invention can be suitably applied to components such as a connector, a terminal, a relay, a spring, and a switch.

The invention claimed is:

1. A copper alloy sheet, comprising:

28.0 mass % to 35.0 mass % of Zn, 0.15 mass % to 0.75 mass % of Sn, 0.005 mass % to 0.05 mass % of P, and a balance consisting of Cu and unavoidable impurities, wherein an average grain size of the copper alloy sheet is 2.0 μm to 7.0 μm, a sum of an area ratio of a β phase and an area ratio of a γ phase in a metallographic structure of the copper alloy sheet is 0% to 0.9%, a Zn content [Zn] (mass %) and a Sn content [Sn] (mass %) satisfy relationships of $44 \geq [Zn]+20\times[Sn] \geq 37$ and $32 \leq [Zn]+9\times([Sn]-0.25)^{1/2} \leq 37$, and wherein the copper alloy sheet is manufactured by a manufacturing process including a finish cold-rolling process of cold-rolling a copper alloy material.

2. A copper alloy sheet, comprising:

28.0 mass % to 35.0 mass % of Zn, 0.15 mass % to 0.75 mass % of Sn, 0.005 mass % to 0.05 mass % of P, either or both of 0.005 mass % to 0.05 mass % of Co and 0.5 mass % to 1.5 mass % of Ni, and a balance consisting of Cu and unavoidable impurities, wherein an average grain size of the copper alloy sheet is 2.0 μm to 7.0 μm, a sum of an area ratio of a β phase and an area ratio of a γ phase in a metallographic structure of the copper alloy sheet is 0% to 0.9%, a Zn content [Zn] (mass %) and a Sn content [Sn] (mass %) satisfy relationships of $44 \geq [Zn]+20\times[Sn] \geq 37$ and $32 \leq [Zn]+9\times([Sn]-0.25)^{1/2} \leq 37$, and wherein the copper alloy sheet is manufactured by a manufacturing process including a finish cold-rolling process of cold-rolling a copper alloy material.

3. A copper alloy sheet, comprising:

28.0 mass % to 35.0 mass % of Zn, 0.15 mass % to 0.75 mass % of Sn, 0.005 mass % to 0.05 mass % of P, 0.003 mass % to 0.03 mass % of Fe, and a balance consisting of Cu and unavoidable impurities, wherein an average grain size of the copper alloy sheet is 2.0 μm to 7.0 μm, a sum of an area ratio of a β phase and an area ratio of a γ phase in a metallographic structure of the copper alloy sheet is 0% to 0.9%, a Zn content [Zn] (mass %) and a Sn content [Sn] (mass %) satisfy relationships of $44 \geq [Zn]+20\times[Sn] \geq 37$ and $32 \leq [Zn]+9\times([Sn]-0.25)^{1/2} \leq 37$, and wherein the copper alloy sheet is manufactured by a manufacturing process including a finish cold-rolling process of cold-rolling a copper alloy material.

4. A copper alloy sheet, comprising:

28.0 mass % to 35.0 mass % of Zn, 0.15 mass % to 0.75 mass % of Sn, 0.005 mass % to 0.05 mass % of P, 0.003 mass % to 0.03 mass % of Fe, either or both of 0.005 mass % to 0.05 mass % of Co and 0.5 mass % to 1.5 mass % of Ni, and a balance consisting of Cu and unavoidable impurities, wherein an average grain size of the copper alloy sheet is 2.0 μm to 7.0 μm, a sum of an area ratio of a β phase and an area ratio of a γ phase in a metallographic structure of the copper alloy sheet is 0% to 0.9%, a Zn content [Zn] (mass %) and a Sn content [Sn] (mass %) satisfy relationships of $44 \geq [Zn]+20\times[Sn] \geq 37$ and $32 \leq$ $[Zn]+9\times([Sn]-0.25)^{1/2}\leq 37$, and a Fe content [Fe] (mass %) satisfy a relationship of $[Co]+[Fe]\leq 0.04$, and wherein the copper alloy sheet is manufactured by a manufacturing process including a finish cold-rolling process of cold-rolling a copper alloy material.

5. The copper alloy sheet according to claim 1, wherein when a tensile strength is denoted by A ($N/mm^2$), an elongation is denoted by B (%), a conductivity is denoted by C (%IACS), and a density is denoted by D ($g/cm^3$), after the finish cold-rolling process, $A\geq 540$, $C\geq 21$, and $340\leq[A\times\{(100+B)/100\}\times C^{1/2}\times 1/D]$.

6. The copper alloy sheet according to claim 1, wherein the manufacturing process includes a recovery heat treatment process after the finish cold-rolling process.

7. The copper alloy sheet according to claim 2, wherein when a tensile strength is denoted by A ($N/mm^2$), an elongation is denoted by B (%), a conductivity is denoted by C (%IACS), and a density is denoted by D ($g/cm^3$), after the finish cold-rolling process $A\geq 540$, $C\geq 21$, and $340\leq[A\times\{(100+B)/100\}\times C^{1/2}\times 1/D]$.

8. The copper alloy sheet according to claim 3, wherein when a tensile strength is denoted by A ($N/mm^2$), an elongation is denoted by B (%), a conductivity is denoted by C (% IACS), and a density is denoted by D ($g/cm^3$), after the finish cold-rolling process, $A\geq 540$, $C\geq 21$, and $340\leq[A\times\{(100+B)/100\}\times C^{1/2}\times 1/D]$.

9. The copper alloy sheet according to claim 4, wherein when a tensile strength is denoted by A ($N/mm^2$), an elongation is denoted by B (%), a conductivity is denoted by C (%IACS), and a density is denoted by D ($g/cm^3$), after the finish cold-rolling process, $A\geq 540$, $C\geq 21$, and $340\leq[A\times\{(100+B)/100\}\times C^{1/2}\times 1/D]$.

10. The copper alloy sheet according to claim 2, wherein the manufacturing process includes a recovery heat treatment process after the finish cold-rolling process.

11. The copper alloy sheet according to claim 3, wherein the manufacturing process includes a recovery heat treatment process after the finish cold-rolling process.

12. The copper alloy sheet according to claim 4, wherein the manufacturing process includes a recovery heat treatment process after the finish cold-rolling process.

* * * * *